US009086667B2

(12) United States Patent
Mochizuki

(10) Patent No.: US 9,086,667 B2
(45) Date of Patent: Jul. 21, 2015

(54) IMAGE FORMING APPARATUS HAVING CURRENT DETECTION

(71) Applicant: CANON KABUSHIKI KAISHA, Tokyo (JP)

(72) Inventor: Masataka Mochizuki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 53 days.

(21) Appl. No.: 13/782,266

(22) Filed: Mar. 1, 2013

(65) Prior Publication Data

US 2013/0230330 A1 Sep. 5, 2013

(30) Foreign Application Priority Data

Mar. 5, 2012 (JP) ..... 2012-047846
Feb. 22, 2013 (JP) ..... 2013-033018

(51) Int. Cl.
*G03G 15/00* (2006.01)
*G03G 15/08* (2006.01)
*G03G 21/18* (2006.01)

(52) U.S. Cl.
CPC ..... *G03G 15/55* (2013.01); *G03G 15/0863* (2013.01); *G03G 15/553* (2013.01); *G03G 21/1889* (2013.01)

(58) Field of Classification Search
CPC ... G03G 15/55; G03G 15/553; G03G 21/181; G03G 2221/16
USPC ..... 399/12, 24, 25, 26, 27, 50, 111, 109
See application file for complete search history.

(56) References Cited

U.S. PATENT DOCUMENTS

| | | | | |
|---|---|---|---|---|
| 5,559,578 | A * | 9/1996 | Umeda et al. | 399/50 |
| 7,035,560 | B2 * | 4/2006 | Okano et al. | 399/50 |
| 7,430,378 | B2 | 9/2008 | Inami et al. | |
| 2006/0056858 | A1 | 3/2006 | Inami et al. | |

FOREIGN PATENT DOCUMENTS

| | | | |
|---|---|---|---|
| JP | 8-146837 | A | 6/1996 |
| JP | 08-152766 | A * | 6/1996 |
| JP | 08-160813 | A * | 6/1996 |
| JP | 10-186972 | A | 7/1998 |
| JP | 3285785 | B2 | 5/2002 |
| JP | 2002-278420 | A | 9/2002 |
| JP | 2006-106692 | A | 4/2006 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus for forming an image on a recording material includes a cartridge, detachably mountable to a main assembly of the image forming apparatus, including a memory and an image forming process member actable on an image bearing member, and a current detecting portion, provided in the main assembly, for detecting a value of current passing through the process member. The current detecting portion detects the value of the current passing through the process member when a voltage is applied to the process member, and the memory stores information for discriminating whether or not the process member is recyclable on the basis of the detected value of the current.

23 Claims, 23 Drawing Sheets

(a) NON-DISCHARGE (b) DISCHARGE

IMAGE FORMING APPARATUS HAVING CURRENT DETECTION

FIELD OF THE INVENTION AND RELATED ART

The present invention relates to an image forming apparatus of an electrophotographic type or the like and relates to a cartridge recycling detecting system for use with the image forming apparatus.

The image forming apparatus forms the image on a recording material (medium) by using an image forming process such as an electrophotographic process, an electrostatic recording process or a magnetic recording process. Examples of the image forming apparatus may include a copying machine, a printer (LED printer, laser beam printer or the like), a facsimile machine, a word processor and a multifunction machine of these machines. The recording material is a material on which the image is formed by the image forming apparatus, and it is a paper sheet, an OHT sheet, a label or the like. The recording material also includes an intermediary transfer member and an image displaying member of the image forming apparatus.

For example, the cartridge is a process cartridge or a developing cartridge, and in a state in which it is detachably mountable to an apparatus main assembly of the image forming apparatus, it acts in an image forming process for forming the image on the recording material. The apparatus main assembly refers to an apparatus constituent portion excluding the cartridge from the constitution of the image forming apparatus.

The process cartridge is prepared by integrally assembling an image bearing member on which a latent image to be formed and at least one of a charging means, a developing means, a cleaning means as process means acting on the image bearing member, into a cartridge, and is detachably mountable to the apparatus main assembly. The image bearing member is an electrophotographic photosensitive member in an electrophotographic image forming process, an electrostatic recording dielectric member in an electrostatic recording image forming process, a magnetic recording magnetic member in a magnetic recording image forming process, and the like. The process cartridge can be mounted to and demounted from the apparatus main assembly by a user himself or herself. For this reason, the maintenance of the image forming apparatus can be easily performed.

Therefore, the process cartridge include a cartridge prepared by integrally assembling the image bearing member and the developing means as the image forming process means and being detachably mountable to the apparatus main assembly. The process cartridge which includes the image bearing member and the developing means integrally is called an integral type. Further, the process cartridge which includes the image bearing member and the process means other than the developing means integrally is called the discrete type. That is, the developing means is provided in a developing unit separated from the process cartridge, and the process cartridge, for forming the image, paired up with the developing unit is referred to as the so-called discrete type.

Further, the developing cartridge includes a developing roller (developer carrying member) and accommodates a developer (toner) used, by the developing roller for developing the latent image formed on the image bearing member, and is detachably mountable to the apparatus main assembly. Also the developing cartridge is detachably mountable to the apparatus main assembly by the user himself (herself). For that reason, the maintenance of the apparatus main assembly can be easily performed.

In the case of the developing cartridge, the image bearing member is mounted to the apparatus main assembly or a cartridge supporting member. Or, the image bearing member is provided in the so-called discrete type process cartridge (in this case, the process cartridge does not include the developing means).

Therefore, as for the cartridge, the integral type process cartridge and the discrete type process cartridge are included. Further, the cartridge includes the case where the discrete type process cartridge and the developing cartridge are used in a pair. Further, the cartridge includes the case where the developing cartridge, in which the image bearing member is fixed to the apparatus main assembly or the cartridge supporting member, is actable on the image bearing member and is detachably mountable to the image bearing member. Further, the cartridge includes a developer cartridge which accommodates the developer (toner) to be supplied to the process cartridge, the developing cartridge, or the like.

In recent years, recycling such that a used (spent) cartridge is collected to realize reuse of parts has been actively made. When the recycling is made, there is a need to discriminate whether or not the cartridge can be disassembled by discriminating whether constituent elements of the cartridge should be disposed of or can be reused. With respect to the constituent elements used for the cartridge, an environment in which the cartridge is to be used, a print number and the like constitute a large discrimination factor for effecting reuse go/no-go (appropriateness) discrimination.

Therefore, into a nonvolatile memory disposed on the cartridge, print number information of the recording material for which the cartridge is used is written. When the cartridge is collected in a recycling factory, the print number information of the recording material is read from the nonvolatile memory in a recycling step, so that whether or not the constituent element of the cartridge is recyclable is discriminated from the print number information. Then, depending on recycling go/no-go discrimination, whether or not the cartridge should be disassembled in the recycling step is determined (Japanese Laid-Open Patent Application (JP-A 2002-278420). Further, a constitution in which with respect to each of the constituent elements of the cartridge, the print number information is stored and then the constituent element is recycled has been proposed (JP-A Hei 8-146837).

However, in the recycling go/no-go discrimination of the cartridge from the print number information cartridge constituent element recycling is not directly discriminated but whether or not the constituent element can be recycled is predicted and discriminated.

Individual cartridges have various use histories and are different in period and temperature/humidity environment in which the cartridge is used. Depending on the use history of the cartridge, even when the print number is the same, there are the cases where the cartridge is recyclable and is not recyclable. For that reason, in the case where the recycling is discriminated from the print number information, accurate recycling discriminating of the constituent element cannot be made, so that disassembling of the cartridge which should not be recycled is made.

SUMMARY OF THE INVENTION

A principal object of the present invention is to provide an image forming apparatus wherein information capable of directly discriminating a state of a constituent element is stored in a memory provided to a cartridge to be mounted in an image forming apparatus main assembly to effect accurate recycling discrimination of the constituent element.

According to an aspect of the present invention, there is provided an image forming apparatus for forming an image on a recording material, comprising: a cartridge, detachably mountable to a main assembly of the image forming apparatus, including a memory and an image forming process member actable on an image bearing member in an image forming process; and current detecting means, provided in the main assembly, for detecting a value of current passing through the image forming process member, wherein the current detecting means detects the value of the current passing through the image forming process member when a voltage is applied to the image forming process member, and the memory stores information for discriminating a state of the image forming process member on the basis of the detected value of the current.

According to another aspect of the present invention, there is provided an image forming apparatus for forming an image on a recording material, comprising: a cartridge, detachably mountable to a main assembly of the image forming apparatus, including a memory and an image forming process member actable on an image bearing member in an image forming process; and discharging component detecting means, provided in the main assembly, for detecting a discharging component between the image bearing member and the image forming process member, wherein the discharging component detecting means detects the discharging component between the image bearing member and the image forming process member when a voltage is applied to the image forming process member, and the memory stores information for discriminating a state of the image forming process member on the basis of the detected discharging component.

According to the present invention, in the memory of the cartridge collected in a recycling factory, accurate information for discriminating a state of an image forming process member for the cartridge is stored. Accordingly, in the recycling factory, based on the information stored in the memory, accurate recycling discriminating of the constituent element can be effected. Therefore, an efficiency of a recycling step can be enhanced.

These and other objects, features and advantages of the present invention will become more apparent upon a consideration of the following description of the preferred embodiments of the present invention taken in conjunction with the accompanying drawings.

Figure 5:
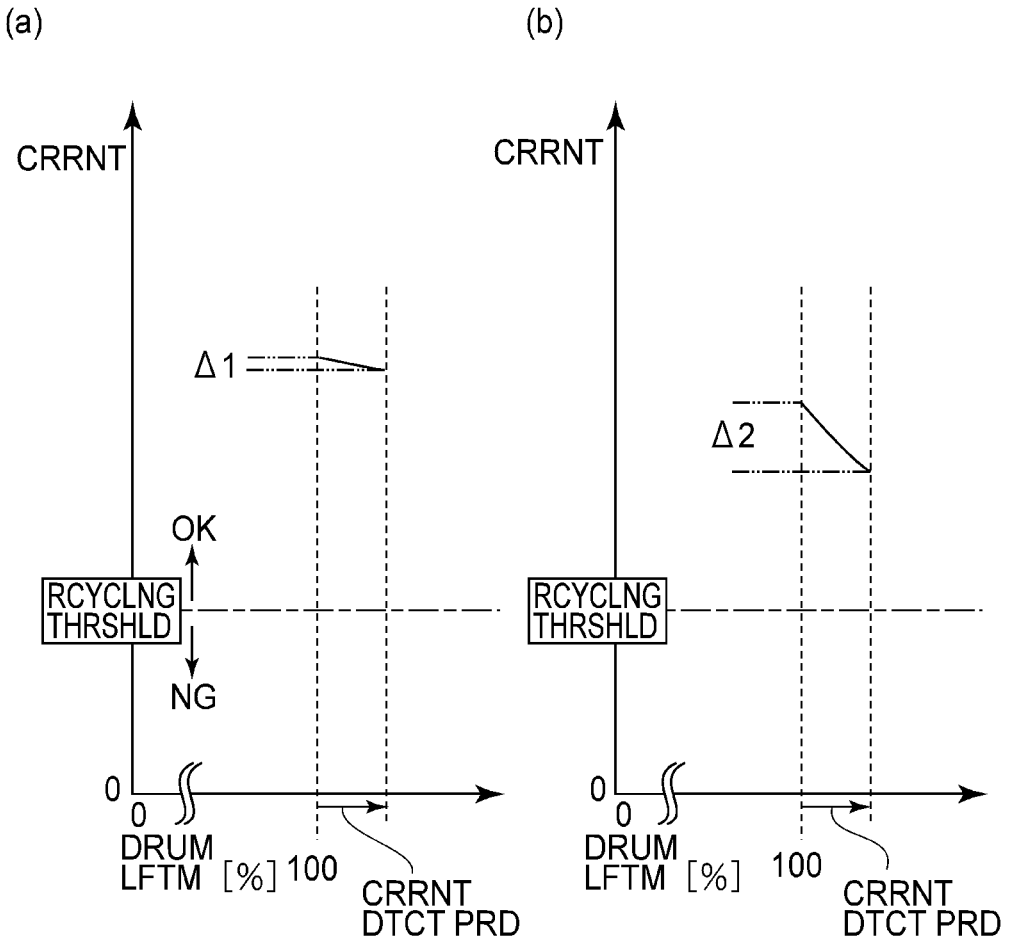

Parts (a) and (b) of FIG. 5 are schematic illustrations of charging roller recycling go/no-go discrimination detection in Embodiment 1.

Figure 6:
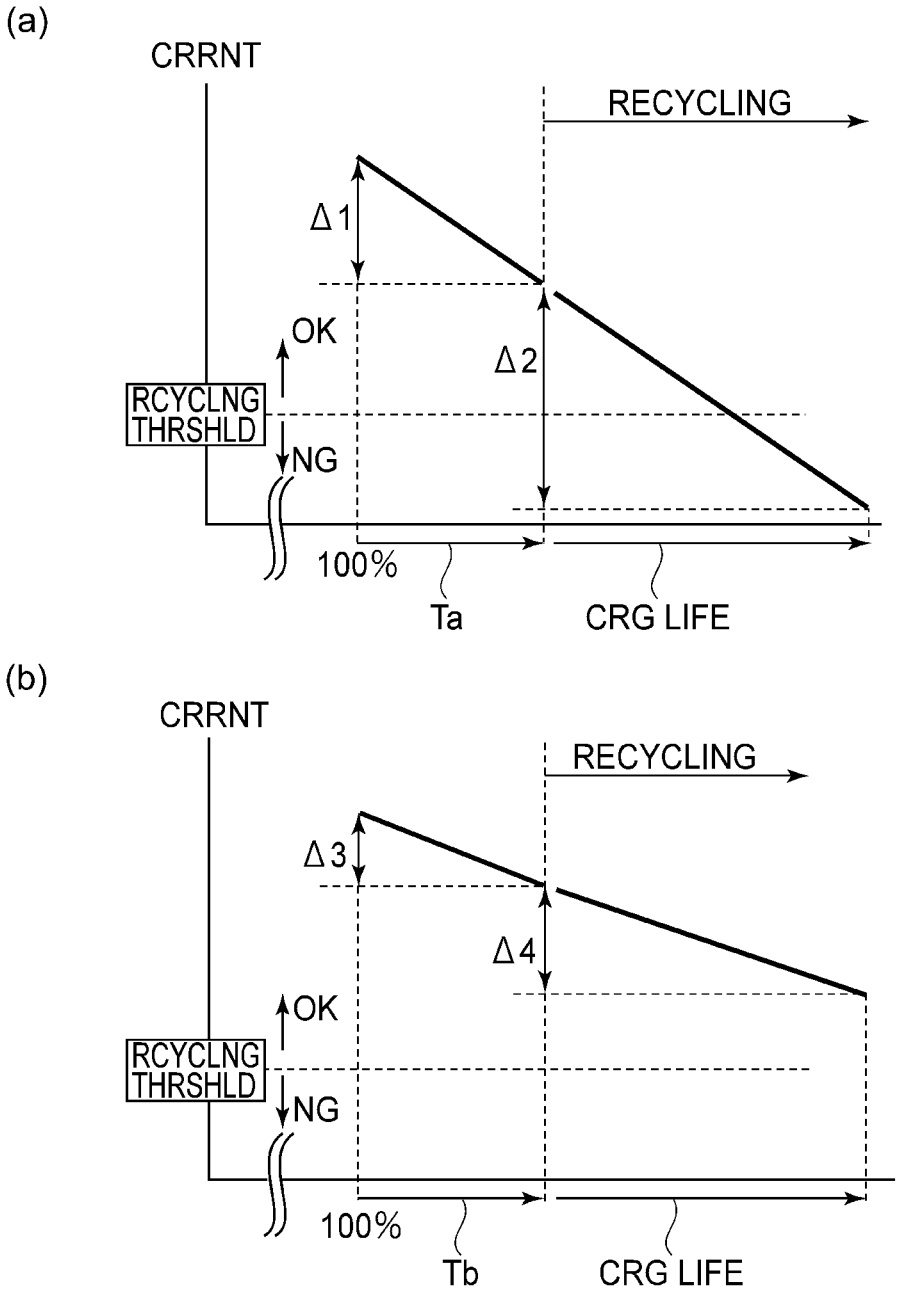

Parts (a) and (b) of FIG. 6 are illustrations of the recycling go/no-go discrimination detection.

Figure 7:
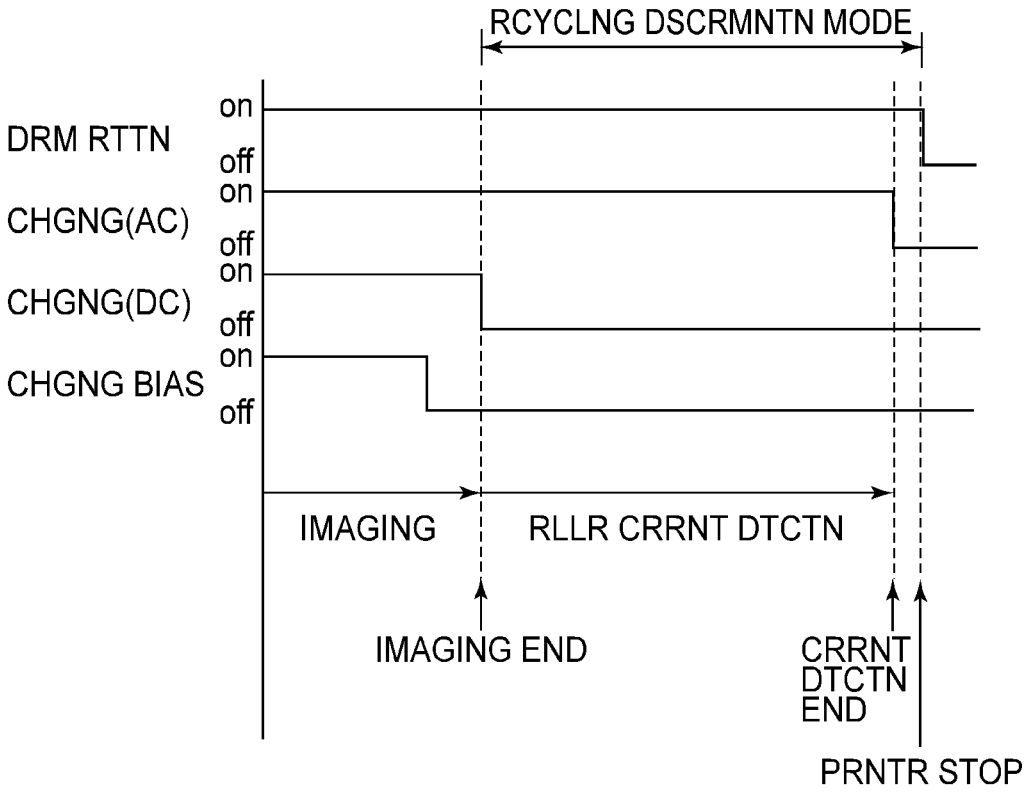

FIG. 7 is a timing chart of recycling discrimination in Embodiments 1 to 4.

Figure 8:
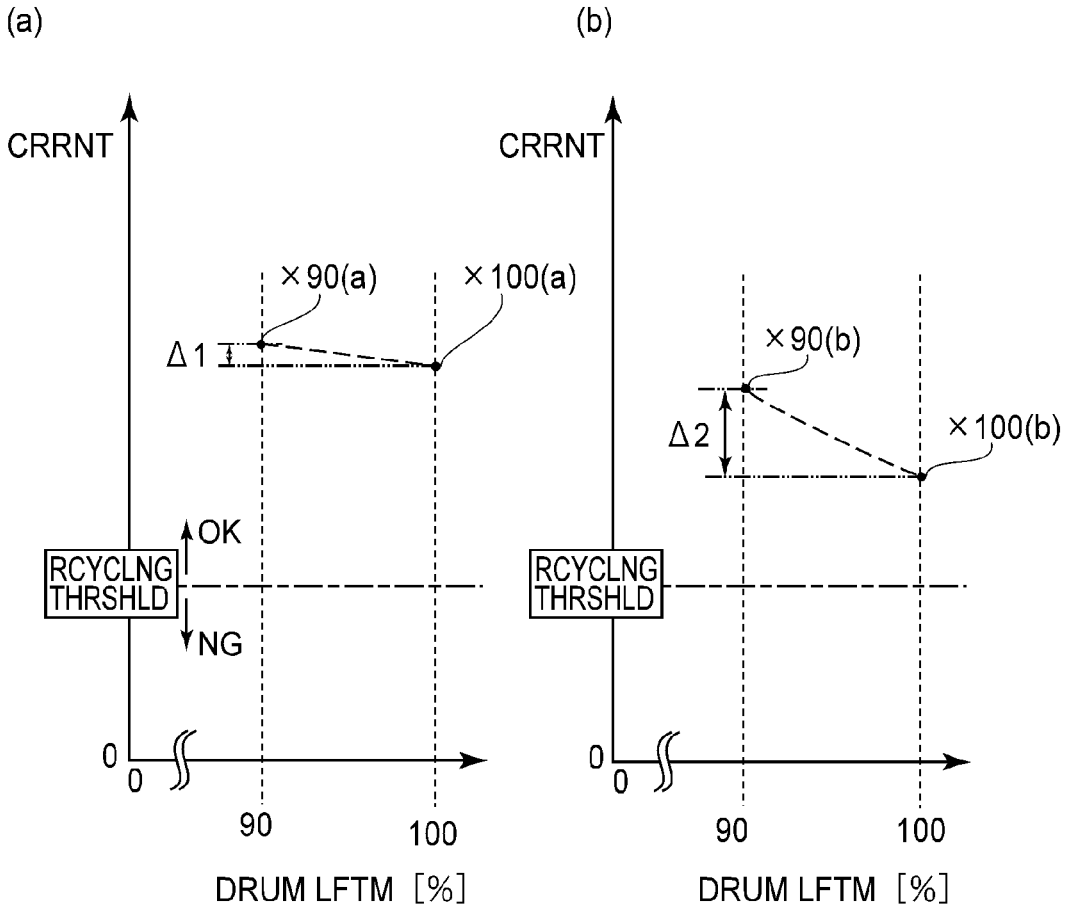

Parts (a) and (b) of FIG. 8 are schematic illustrations of charging roller recycling go/no-go discrimination detection in Embodiment 2.

Figure 9A:
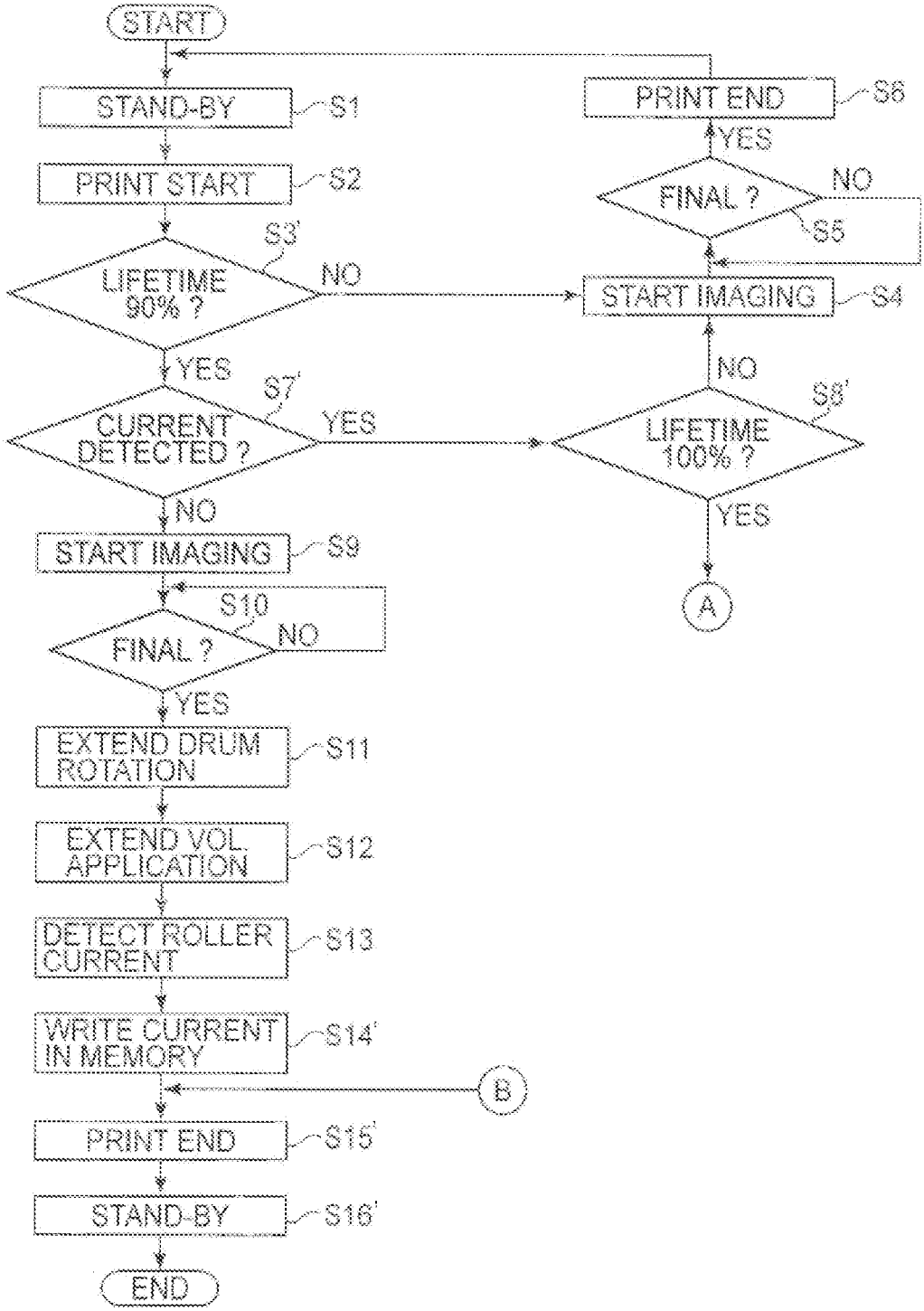
Figure 9B:
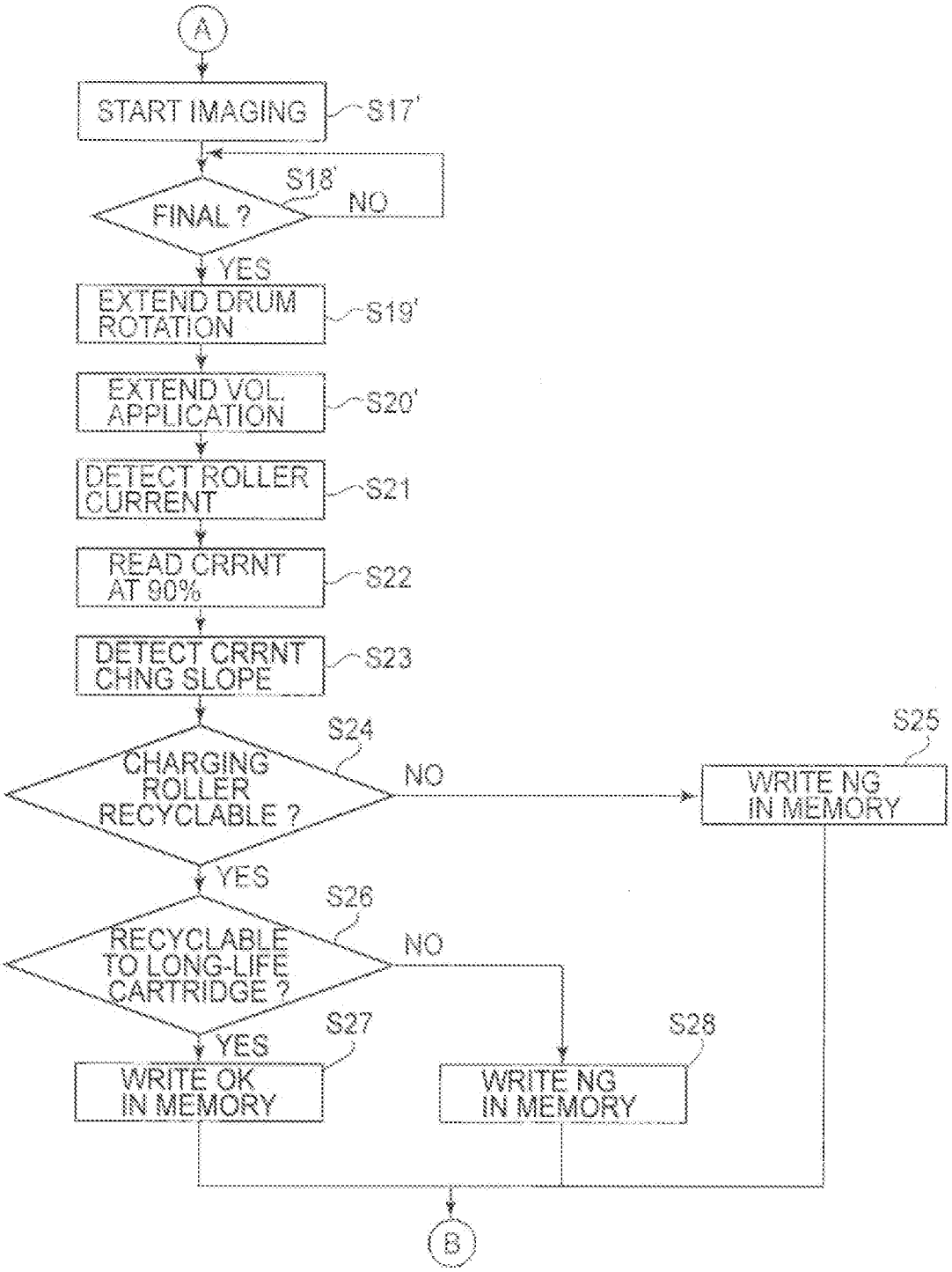

FIG. 9A is a control flow chart (part 1) in Embodiment 2, and FIG. 9B is a control flow chart (part 2) in Embodiment 2.

Figure 10:
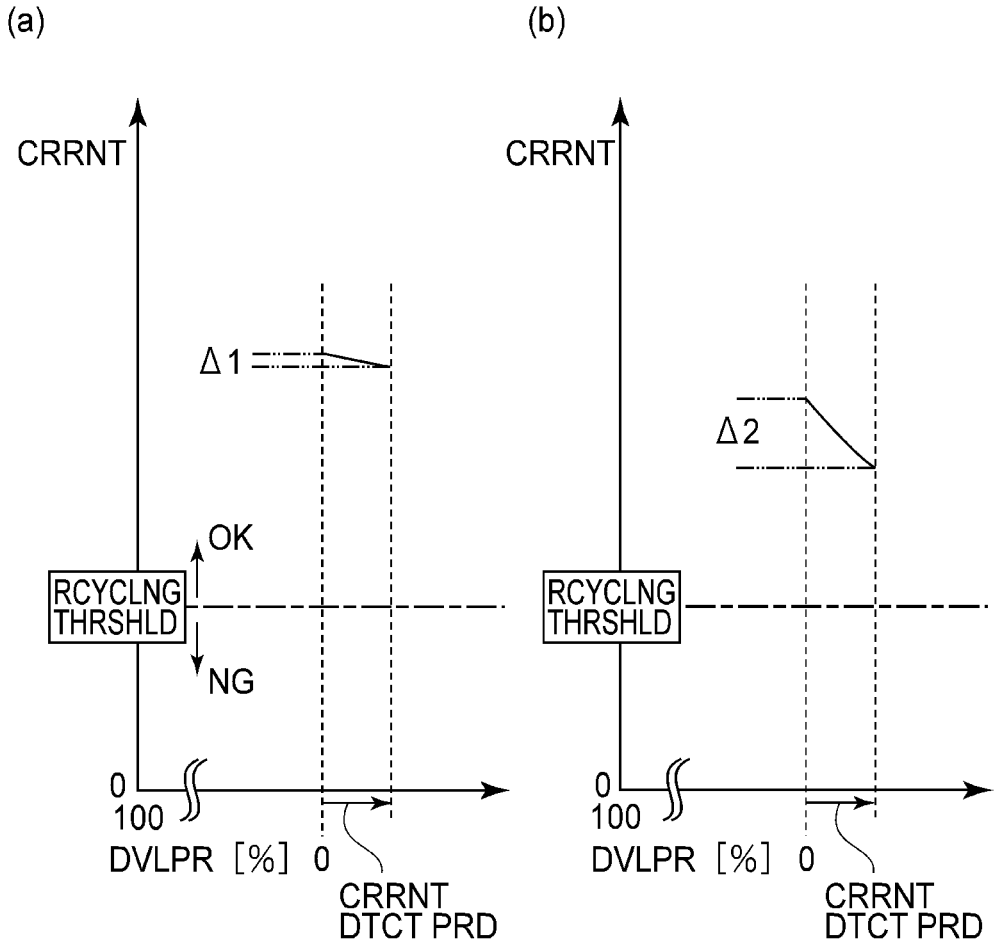

Parts (a) and (b) of FIG. 10 are schematic illustrations of charging roller recycling go/no-go discrimination detection in Embodiment 3.

Figure 11:
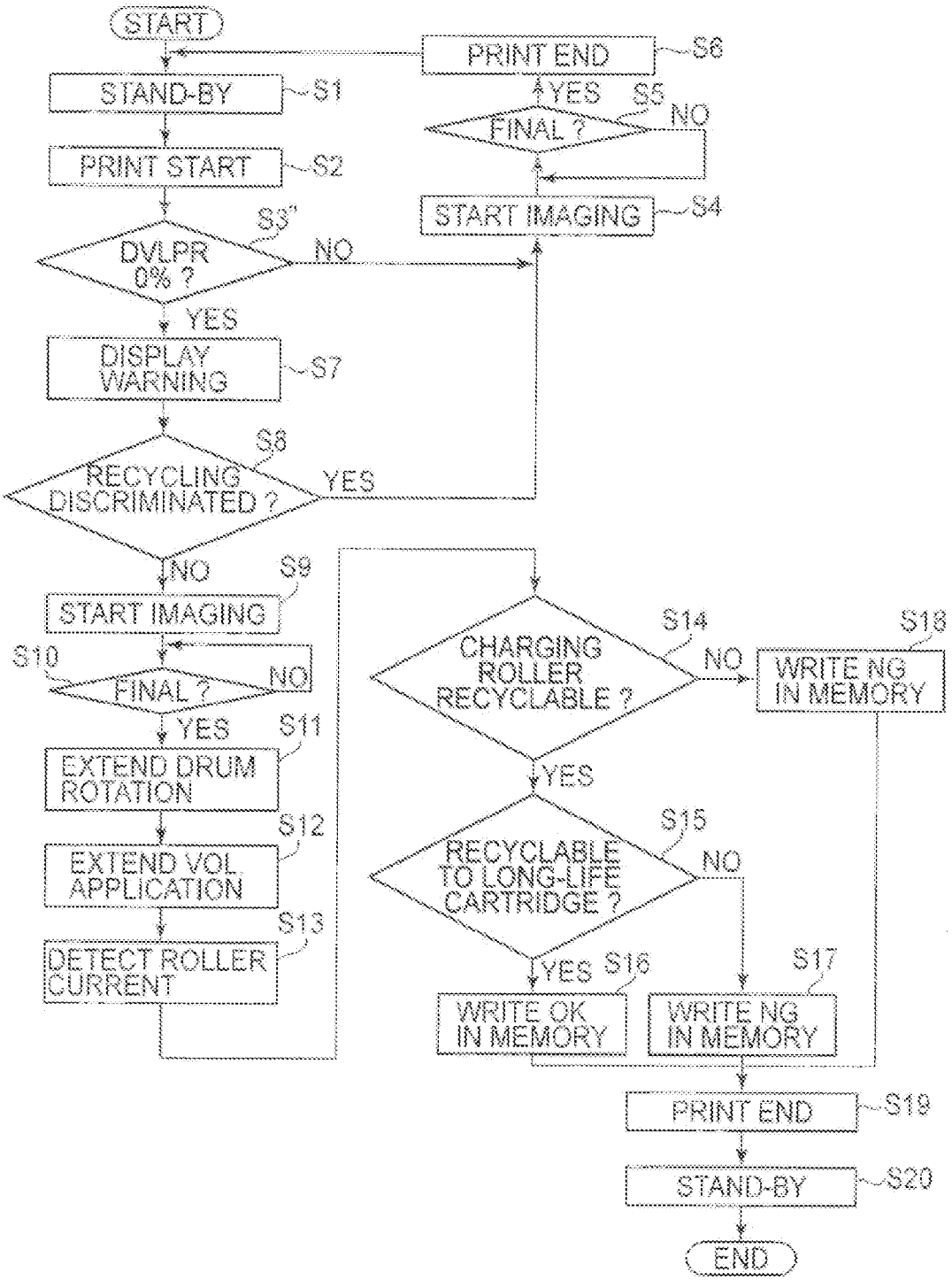

FIG. 11 is a control flow chart in Embodiment 3.

Figure 12:
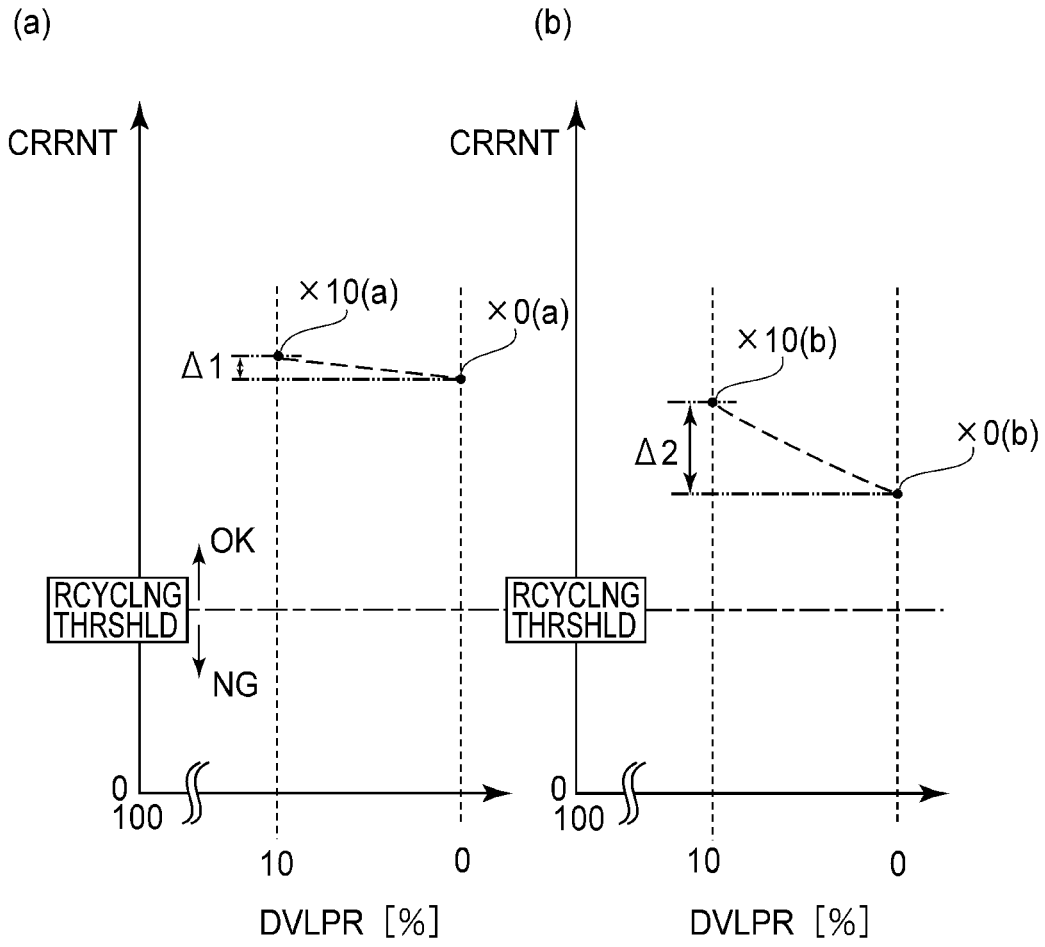

Parts (a) and (b) of FIG. 12 are schematic illustrations of charging roller recycling go/no-go discrimination detection in Embodiment 4.

Figure 13A:
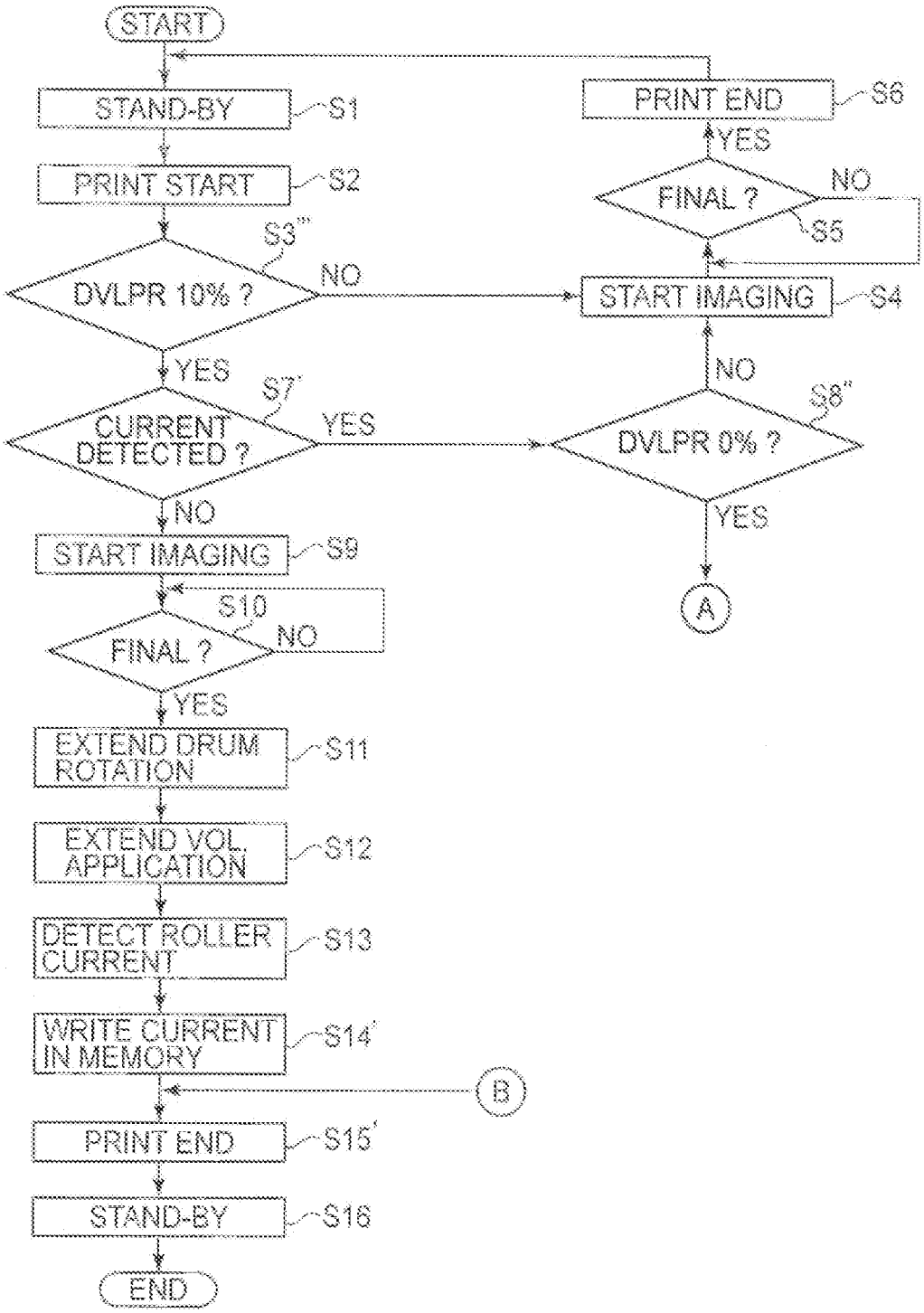
Figure 13B:
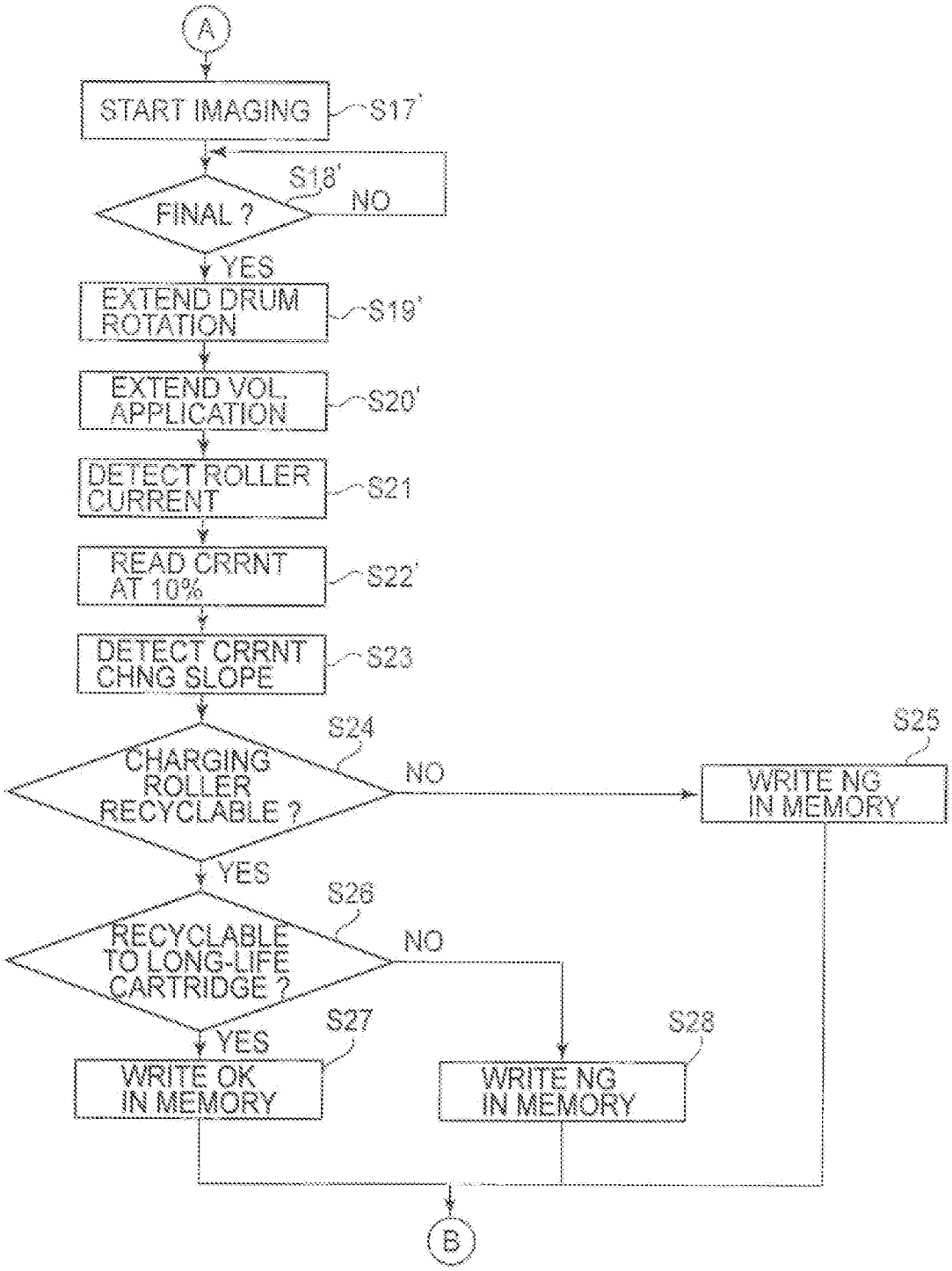

FIG. 13A is a control flow chart (part 1) in Embodiment 4, and FIG. 13B is a control flow chart (part 2) in Embodiment 4.

Figure 14:
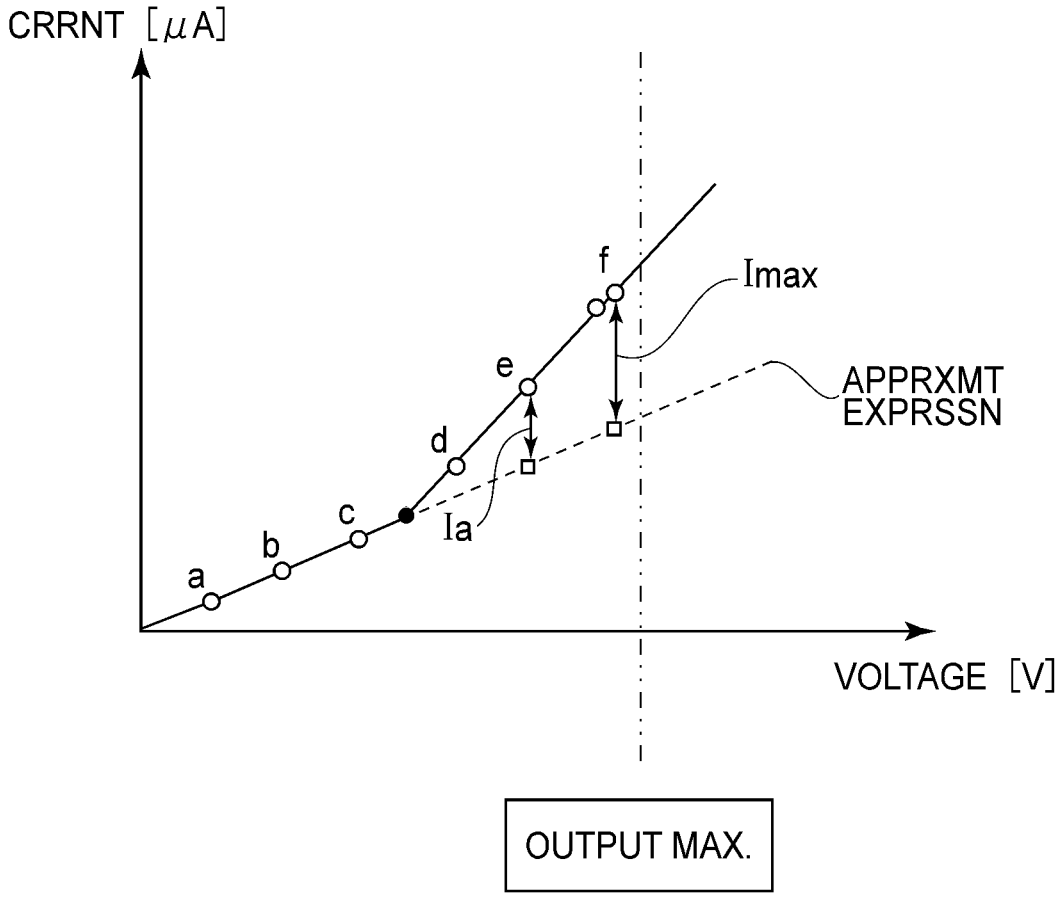

FIG. 14 is a graph for illustrating a discharging component detecting method in Embodiment 4.

Figure 15:
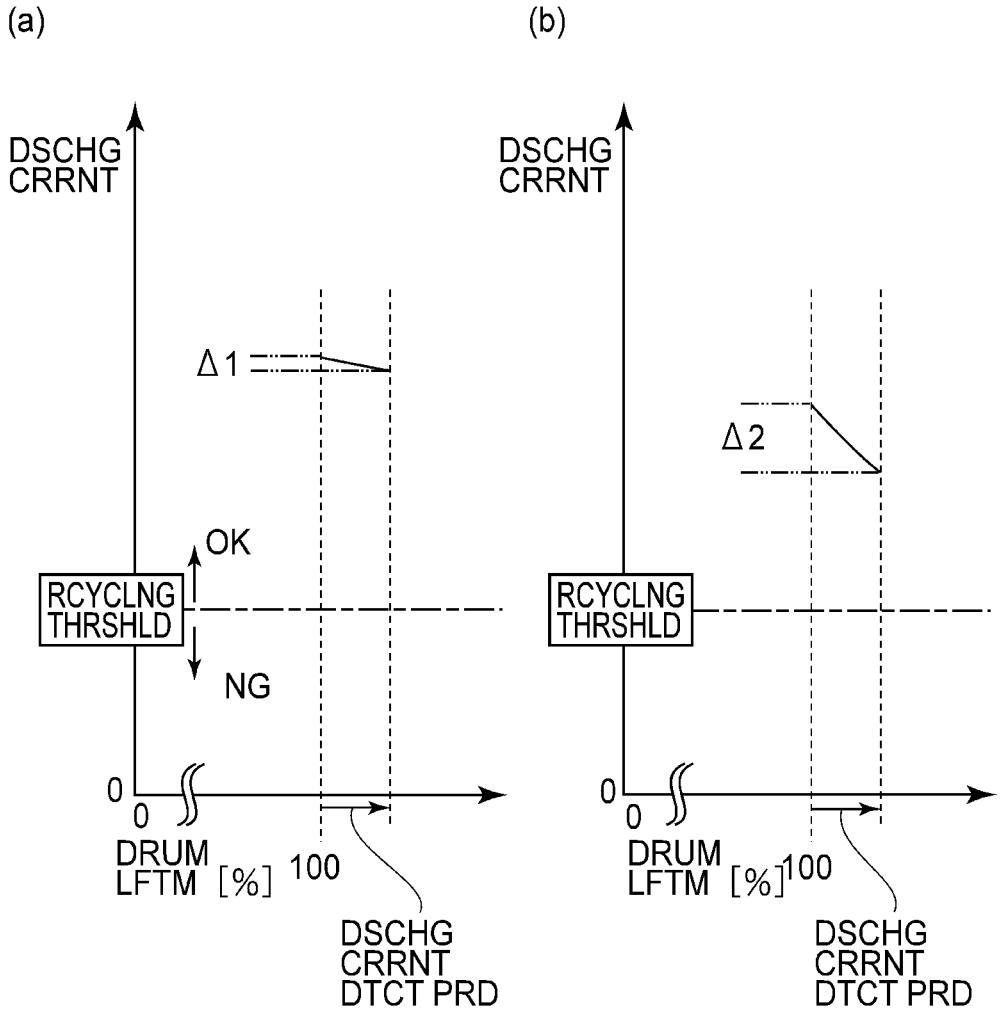

Parts (a) and (b) of FIG. 15 are schematic illustrations of charging roller recycling go/no-go discrimination detection in Embodiment 5.

Figure 16:
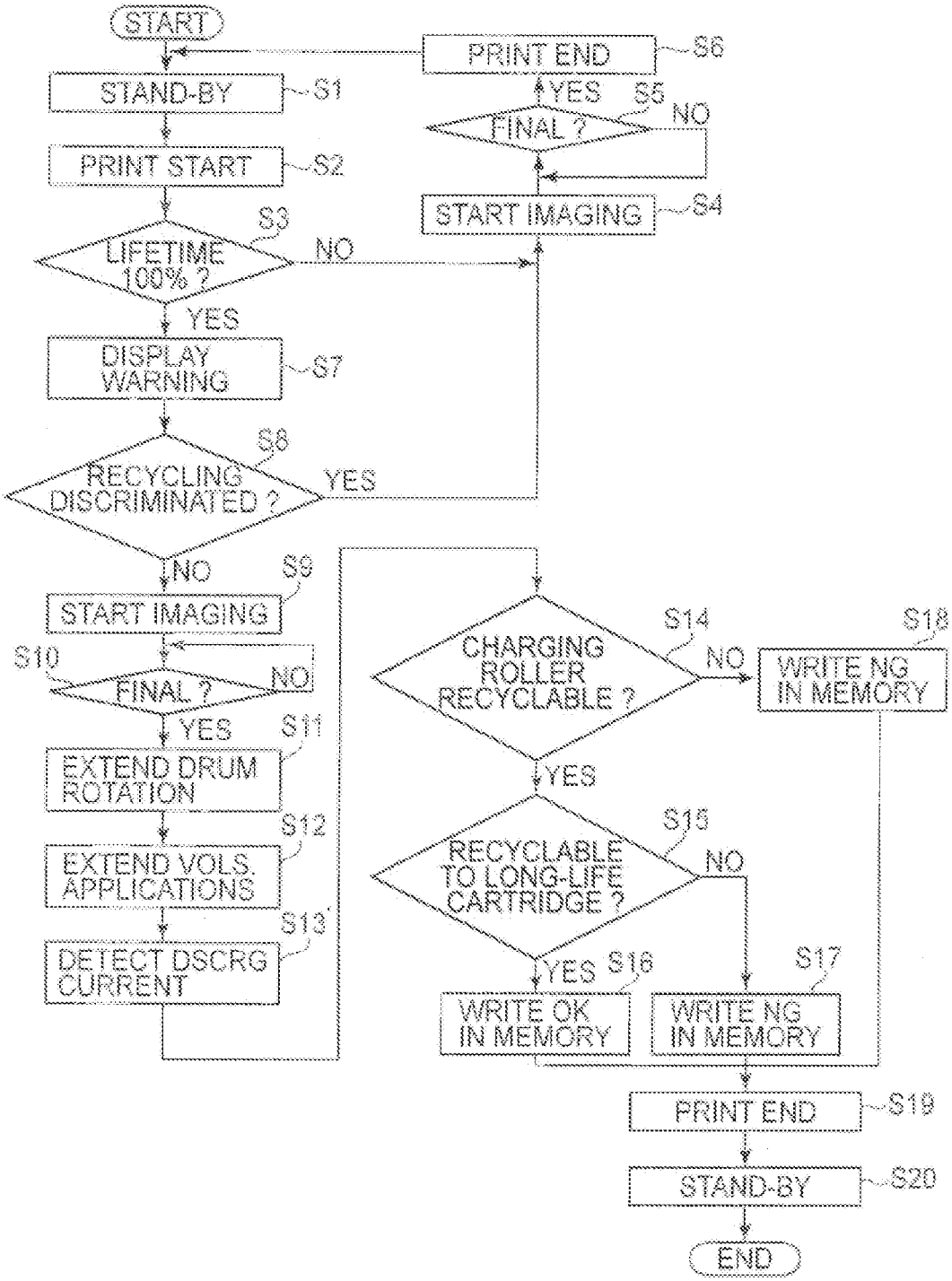

FIG. 16 is a control flow chart in Embodiment 5.

Figure 17:
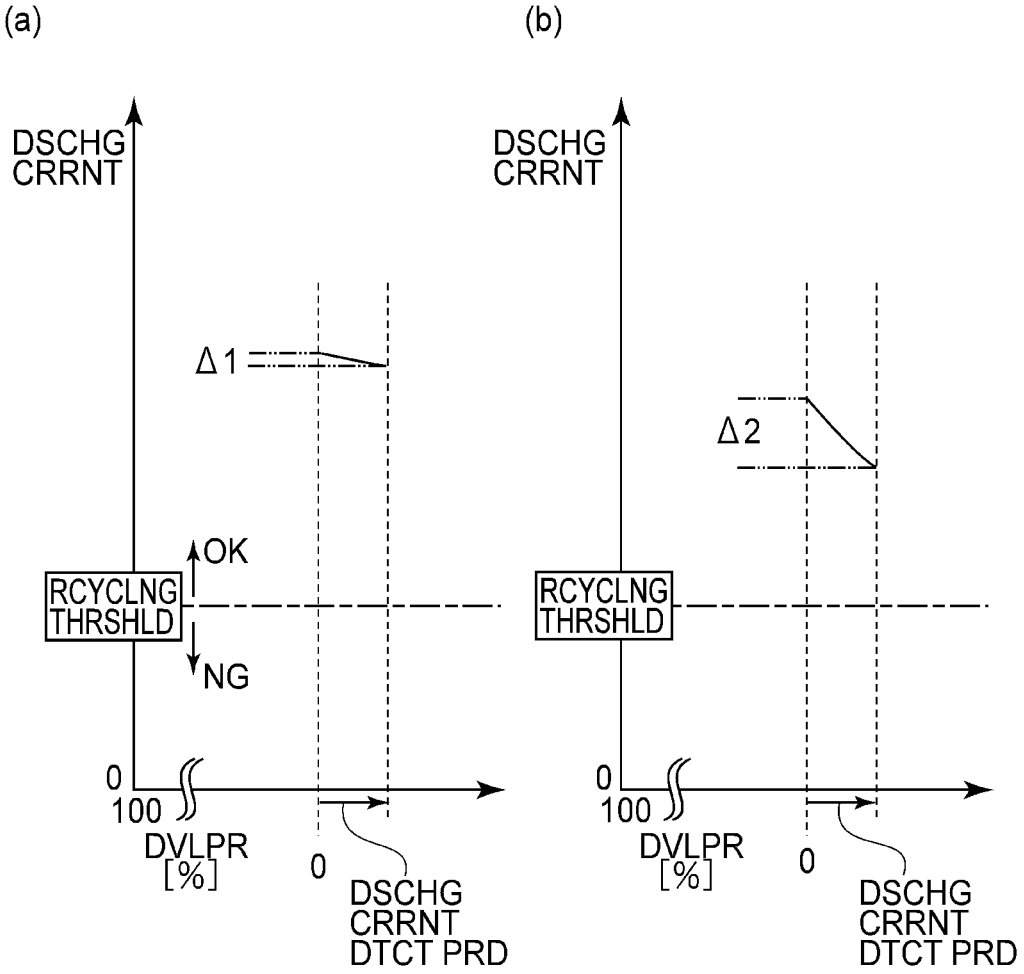

Parts (a) and (b) of FIG. 17 are schematic illustrations of charging roller recycling go/no-go discrimination detection in Embodiment 6.

Figure 18:
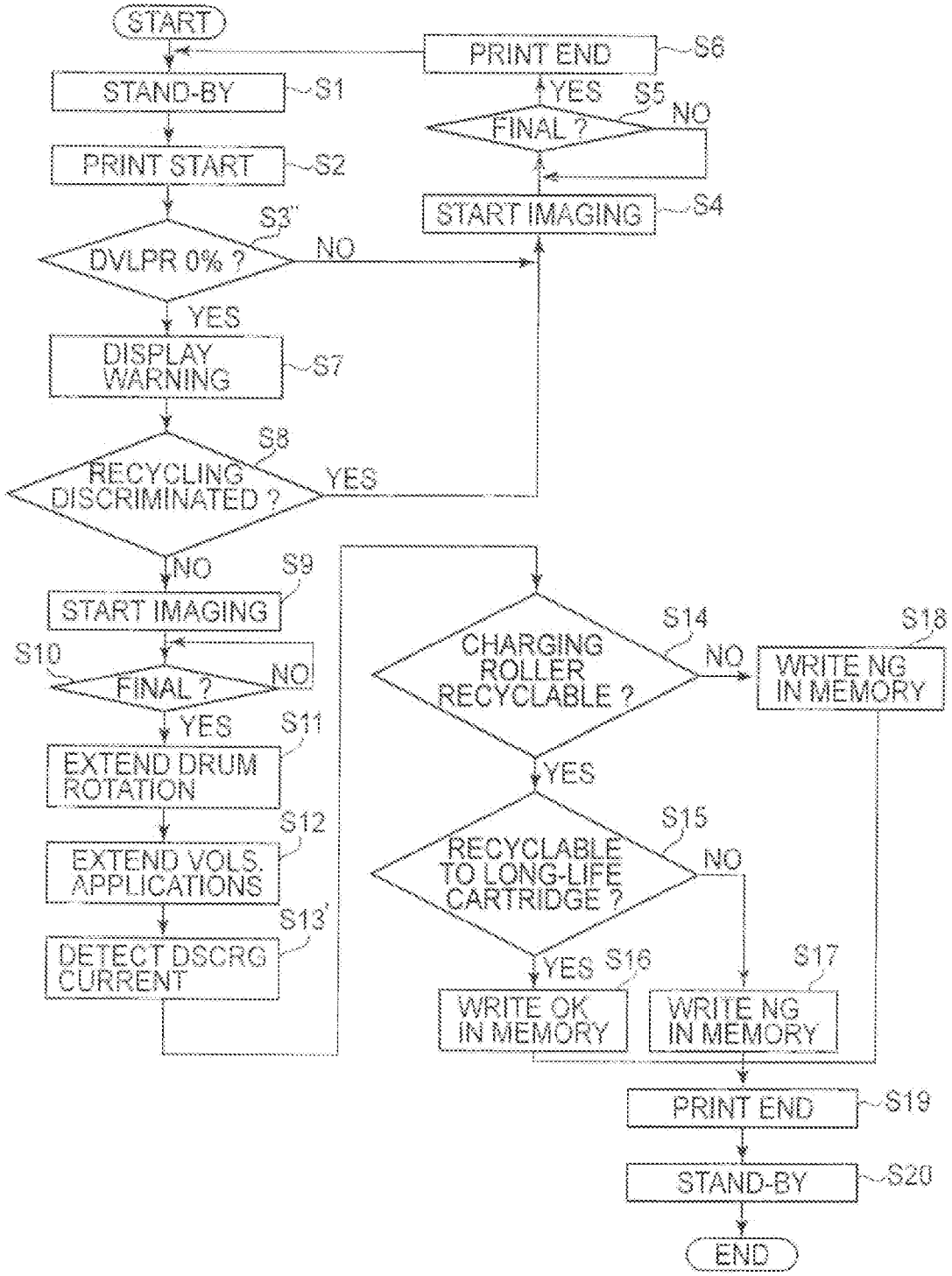

FIG. 18 is a control flow chart in Embodiment 6.

Figure 19:
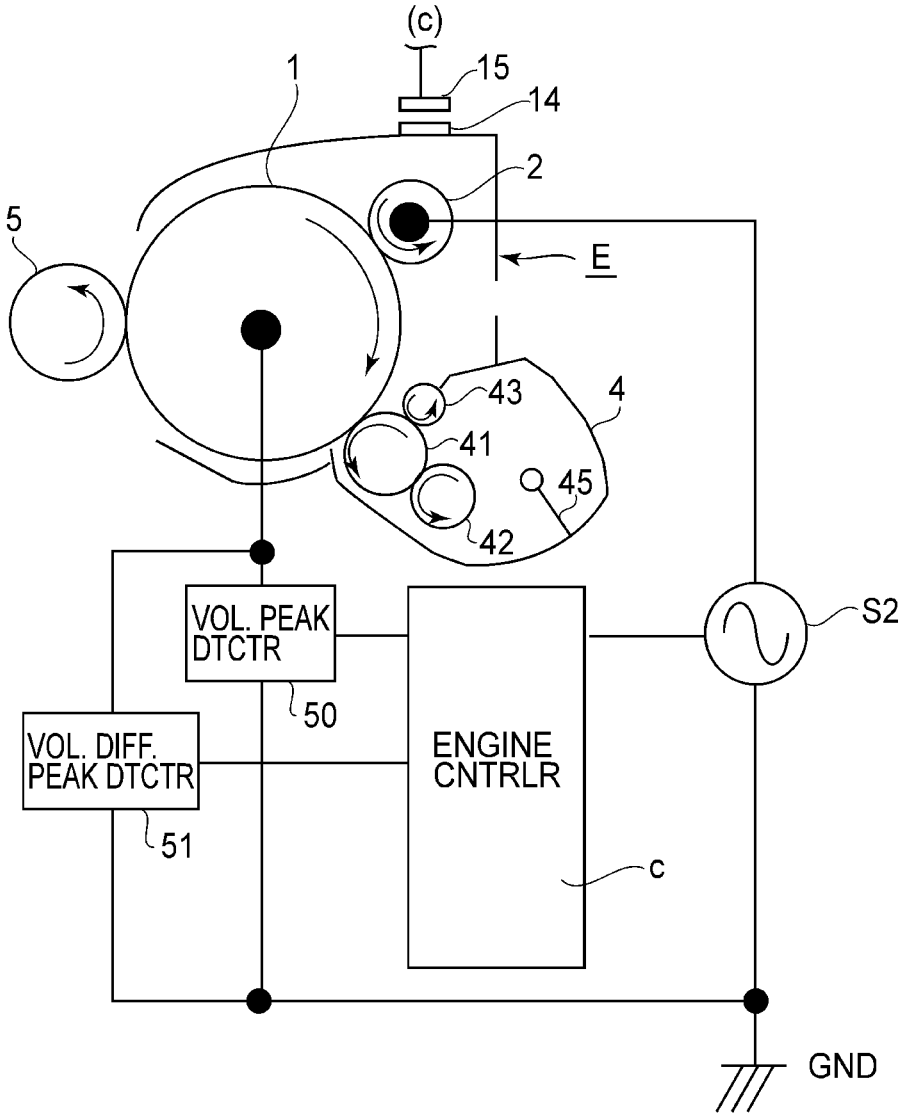

FIG. 19 is a schematic illustration of discharging component detection in Embodiment 7.

Figure 20:
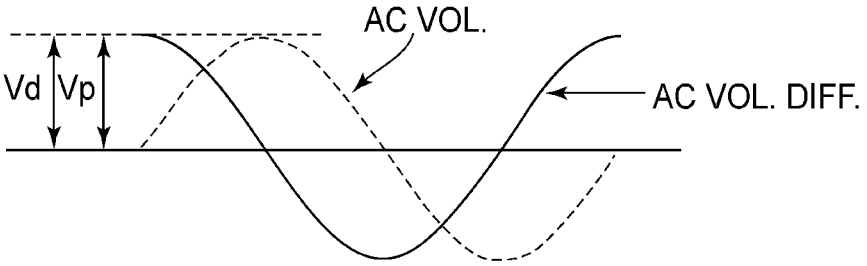
Figure 20:
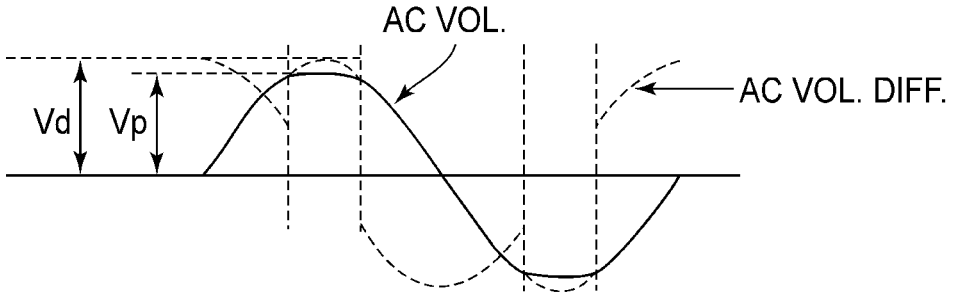

Parts (a) and (b) of FIG. 20 are illustrations of a discharging component detecting method in Embodiment 7.

Figure 21:
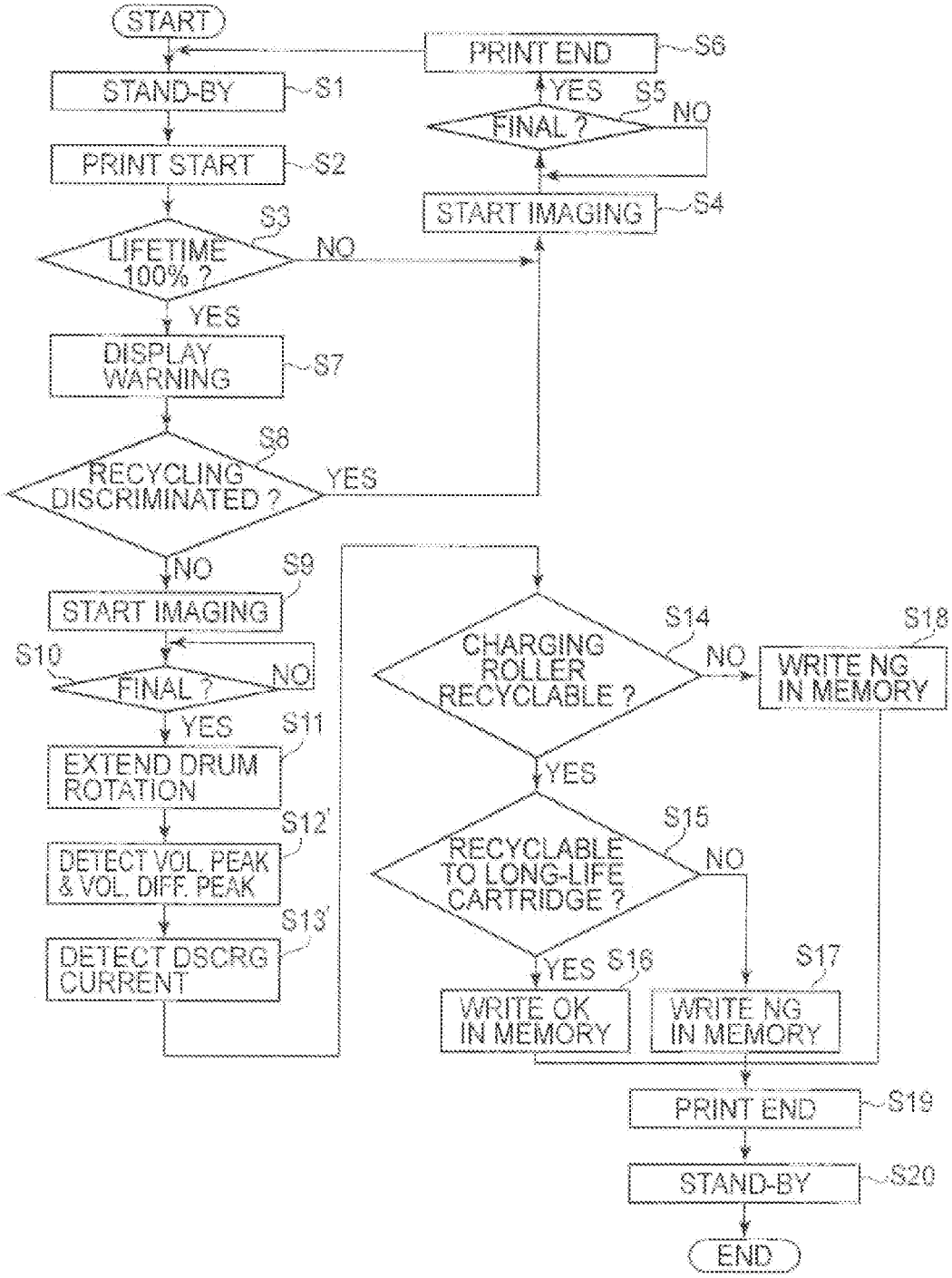

FIG. 21 is a contact flow chart in Embodiment 7.

DESCRIPTION OF THE PREFERRED EMBODIMENTS

Embodiment 1

(1) Image Forming Portion

Figure 2:
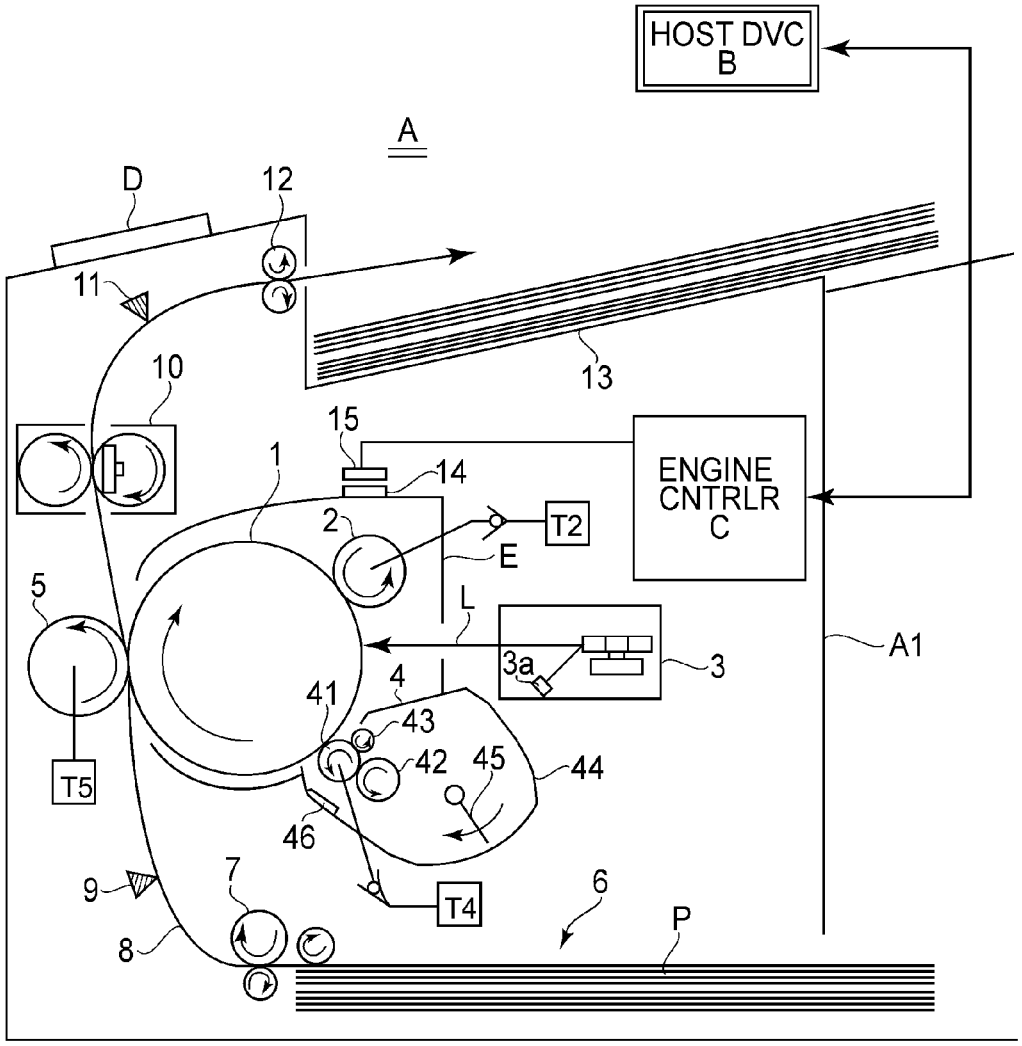
FIG. 2 is a schematic illustration of an image forming apparatus in Embodiments 1 to 7.
Figure 3:
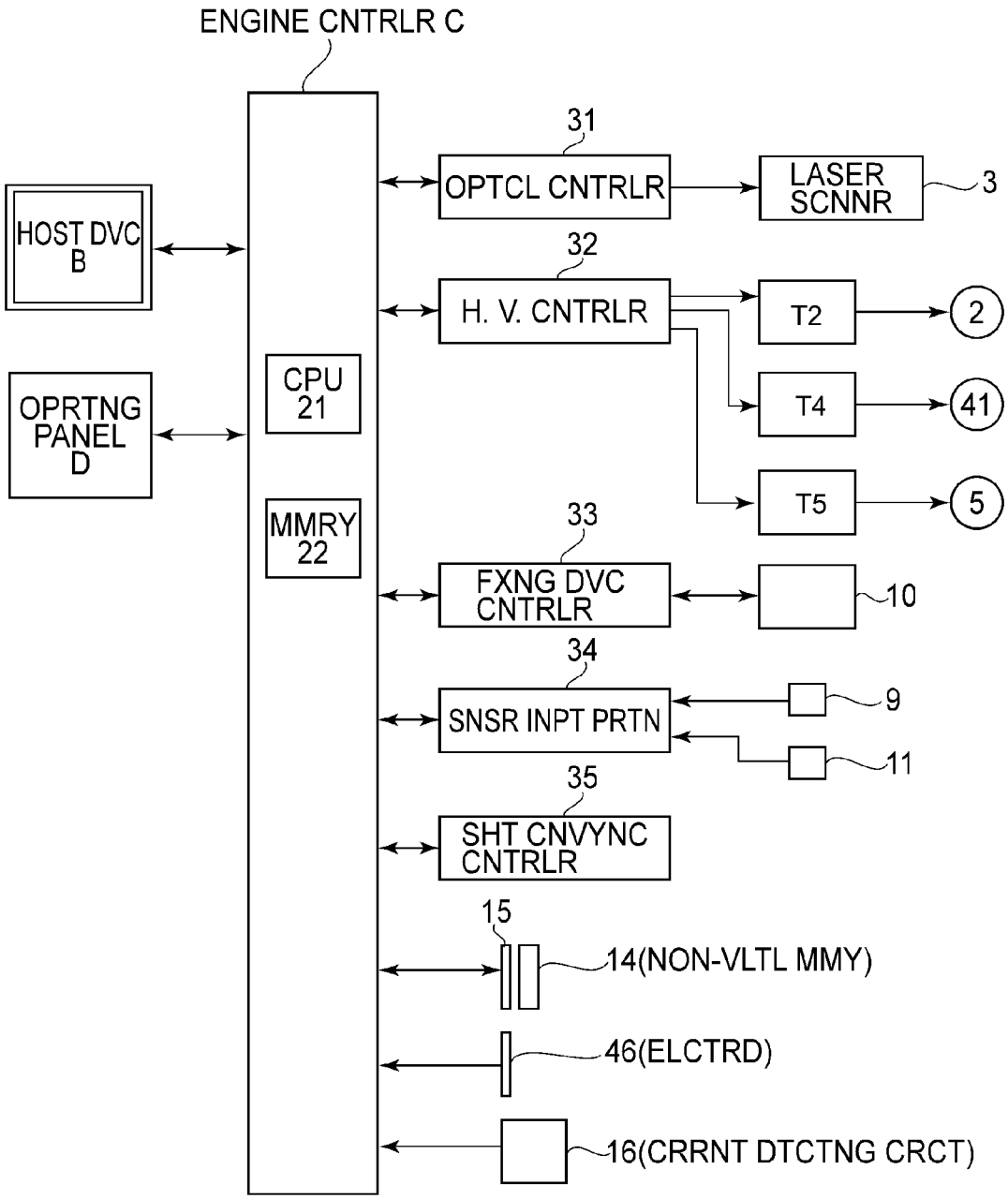
FIG. 3 is a block diagram of a control system of the image forming apparatus.

FIG. 2 is a schematic illustration of an example of an image forming apparatus according to the present invention or an image forming apparatus using a recycling detecting system of a cartridge according to the present invention. FIG. 3 is a block diagram of a current system of an image forming apparatus A.

This image forming apparatus A is an electrophotographic laser printer of a process cartridge mounting and demounting type, and on the basis of image information (electric image signal) inputted from a host device B into an engine controller (control means) C, an image is formed on a sheet-like recording material (recording medium) P. The host device B is a personal computer, an image reader, a network, a facsimile machine or the like.

The engine controller C includes CPU 21 and memory (ROM, RAM) 22 and transfers various pieces of electrical information between itself and the host device B or an operating panel D. Further, the engine controller C effects integrated control of an image forming operation (print operation) of the image forming apparatus A in accordance with a predetermined control program or reference table held in a memory 22.

A cartridge E is detachably mountable to an apparatus main assembly (image forming apparatus main assembly) A1 of the image forming apparatus A, and is a cartridge including a memory and an image forming process member actable on a rotatable image bearing member in an image forming process in a state in which the cartridge E is mounted in the apparatus main assembly A1. The cartridge E will be specifically described later in (2).

The apparatus A includes an electrophotographic photosensitive drum 1 as the rotatable image bearing member. In this embodiment, the drum 1 is prepared by successively applying, as a photosensitive layer, a charge generating layer and a charge transporting layer on an outer peripheral surface of an aluminum cylinder. The drum 1 is rotationally driven in the clockwise direction indicated by an arrow at a predetermined peripheral speed (process speed). At a periphery of this drum 1, as an image forming process means (image forming process member: image forming member) actable on the drum 1, a charging means 2, an exposure means 3, a developing means 4 and a transfer means 5 are provided along a rotational direction.

The charging means (charging member) 2 is a means for electrically charging the surface of the drum 1 and is a charging roller (contact charging member) in this embodiment. The charging roller 2 is an electroconductive roller formed in a roller shape by forming an electroconductive urethane rubber layer around a core metal coaxially and integrally so as to have an ASKER-C hardness of 50-70 degrees.

The charging roller 2 is arranged in parallel to the drum 1 and is provided while being urged at a predetermined urging force, and is a rotatable member which is to be rotated by rotation of the drum 1. To the charging roller 2, a charging bias having a predetermined polarity and a predetermined potential is applied from a charging bias power (voltage) source portion T2, so that the outer peripheral surface of the drum 1 is control-charged uniformly to a predetermined charge potential Vd (dark portion potential).

The exposure means 3 is an exposure device for forming a latent image on the drum 1, and in this embodiment, is a laser scanner for scanning the uniformly charged surface of the drum 1 with a laser beam by a semiconductor layer 3*a*. That is, the uniformly charged surface of the rotating drum 1 is subjected by the scanner 3 to the scanning exposure to laser light L modulated depending on the image information, so that the potential of the drum 1 at an exposed portion is attenuated from the dark portion potential Vd to a light portion potential V1. By a potential contrast between the dark portion potential Vd and the light portion potential V1, the latent image (electrostatic latent image) corresponding to the image information for the laser light L to which the peripheral surface of the drum is exposed is formed.

The developing means 4 is a means for developing, as a developer image, the latent image formed on the surface of the drum 1. In this embodiment, the developing means 4 is a reverse developing device of a control type using a non-magnetic one-component developer.

The developing device includes a developing roller 41 as a rotatable developer carrying member for developing, with a developer, the latent image held on the drum 1. Further, the developing device includes a supplying roller (developer supplying member) 42 for supplying the developer to the developing roller 41 and includes a regulating roller 43 as a developer layer thickness regulating member for regulating an amount of the developer to be placed on the developing roller 41. Further, the developing device includes a developer accommodating portion (developer accommodating container) 44 in which the developer (not shown) to be supplied to the developing roller 41 is accommodated, a stirring member 45 for feeding the developer toward the supplying roller (developer supplying member) 42 while stirring the developer in the developer accommodating portion 44, and the like member.

The developing roller 4 is, similarly as the charging roller 2, an electroconductive roller formed in a roller shape by forming an electroconductive urethane rubber layer around a core metal coaxially and integrally so as to have an ASKER-C hardness of 50-70 degrees. The developing roller 4 is arranged in parallel to the drum 1 and is provided while being urged at a predetermined urging force, and is rotationally driven in the counterclockwise direction indicated by an arrow at a speed ratio R thereof with respect to a rotational speed of the drum 1.

The supplying roller (developer supplying member) 42 is an elastic sponge roller arranged in parallel to the developing roller 41 and is provided while being urged at a predetermined urging force in a side opposite from the drum side of the developing roller 41. The supplying roller 42 is rotationally driven in a direction opposite to the rotational direction of the developing roller 41 at a control portion thereof with the developing roller 41, thus supplying the developer to the surface of the developing roller 41.

The regulating roller (developer layer thickness regulating member) 43 is an elastic roller arranged in parallel to the developing roller 41 and is provided while being urged at a predetermined urging force in a downstream side of the supplying roller 42 with respect to the rotational direction of the developing roller 41. The regulating roller 43 is rotationally driven in a direction opposite to the rotational direction of the developing roller 41 at a control portion thereof with the developing roller 41 to regulate an amount of the developer supplied to the surface of the developing roller 41 by the supplying roller 42, thus uniformly adjusting the developer layer on the surface of the developing roller 41 in the small thickness.

The developer accommodated in the developer accommodating portion 44 is the non-magnetic one-component developer in this embodiment, and is a negative developer (negative toner) having the same charge polarity as the drum 1. The developer carried on the developing roller 41 is electrically charged to the same polarity as the charge polarity of the drum 1 by friction of the supplying roller 42 and the regulating roller 43 with the developing roller 41.

To the developing roller 41, a predetermined developing bias (DC voltage+AC voltage) is applied from a developing bias power source portion T4. As a result, at a developing portion which is a contact portion between the drum 1 and the developing roller 41, the developer in the developing roller 41 side is selectively transferred onto the drum 1 in a region of the light portion potential V1, so that the latent image in the drum 1 side is reversely developed as the developer image.

The transfer means 5 is a means for transferring the developer image, formed on the drum 1, onto the recording material (recording medium) P, and is a transfer roller in this embodiment. The transfer roller 5 is an electroconductive elastic roller, and is arranged in parallel to the drum and is provided while being urged at a predetermined urging force. The transfer roller 5 is rotated by the rotation of the drum 1. Into a transfer nip which is a contact portion between the transfer roller 5 and the drum 1, the recording material P is introduced at predetermined control timing from a sheet feeding portion side and then is nipped and conveyed.

During a period from the introduction of the recording material P into the transfer nip until the recording material P completely passes through the transfer nip, a transfer bias which has an opposite polarity to the charge polarity of the developer and which has a predetermined potential is applied from a transfer bias power source portion T5. As a result, the developer image in the drum 1 side is successively transferred electrostatically onto the recording material P passing through the transfer nip.

Sheets of the recording material P are stacked and accommodated in a sheet feeding portion 6 at a lower portion in the image forming apparatus A. At predetermined control timing, the sheet feeding roller 7 is driven, so that a sheet of the recording material P in the sheet feeding portion 6 is separated and fed. The recording material P passes through a conveying path 8 and is introduced into the transfer nip, where the developer image is transferred onto the recording material P. A top sensor 9 for achieving synchronization with the conveyance of the recording material P is provided to the conveying path 8.

The recording material P coming out of the transfer nip is separated from the surface of the drum 1 and then is introduced into a fixing device 10, where an unfixed developer image on the recording material P is fixed as a fixed image. Then, the recording material P coming out of the fixing device 10 is discharged, as an image-formed product, onto a sheet discharge tray 13 by a sheet discharging roller pair 12. A sheet discharge sensor 11 for detecting the presence or absence of the recording material P after the fixing is provided.

Referring to FIG. 3, the engine controller C controls an optical system controller 31 for controlling the laser scanner 3, a high-voltage controller 32 for controlling output of each of high voltages in steps of the charging, the development, the transfer and the like, and a fixing device controller 33 for controlling a temperature of the fixing device 10. Further, the engine controller C controls a sensor input portion 34 for detecting a paper presence/absence state of the sheet discharge sensor 11, and a sheet conveyance controller 35 for effecting drive/stop of motor/roller and the like for conveying the recording material P.

(2) Cartridge E

In the image forming apparatus A in this embodiment, the developing roller 2 and the developing device 4 which are process means actable on the drum 1 are integrally assembled into the cartridge (process cartridge of the integral type) E detachably mountable to a predetermined mounting portion of the apparatus main assembly A1. The cartridge E is mounted to the predetermined mounting portion in the apparatus main assembly A1 in a predetermined manner. Further, the cartridge E is demounted from the predetermined mounting portion in the apparatus main assembly A1 in a predetermined manner. That is, the cartridge E is used by being replaced with a new one.

In a state in which the cartridge E is mounted to the mounting portion in the apparatus main assembly A1 in the predetermined manner, a drive and bias input portion (not shown) in the cartridge E side is connected to a drive and bias output portion (not shown) in the apparatus main assembly A1 side. As a result, a driving force of a driving source in the apparatus main assembly A1 side is transferred to the cartridge E side to drive the drum and the developing roller 41, supplying roller 42, regulating roller 43 and stirring member 45 of the developing device 4.

Further, a bias of a power source portion in the apparatus main assembly A1 side is applied to the cartridge E side, so that the charging bias application to the charging roller 2 and the developing bias application to the developing roller 41 are effected. That is, the apparatus A is capable of performing an image forming operation.

Further, the cartridge E includes a memory (storing means) 14 capable of reading and writing various pieces of information. The cartridge E may preferably include a non-volatile memory. In a state in which the cartridge E is mounted to the mounting portion in the apparatus main assembly A1 in the predetermined manner, an information transmitting portion (communicating means) 15 of the apparatus main assembly A1 side is in a state in which it opposes the memory 14. As a result, the engine controller C is capable of transferring the information with respect to the memory 14 via the information transmitting portion 15, so that the CPU 21 communicates with the memory 14 to effect reading and store (writing) of the information. The memory provided to the cartridge E may also be only required to store a signal sent from the controller without performing the transfer of the information with respect to the apparatus main assembly A1. That is, if the memory can store the information for discriminating a state of the image forming process member, this function of the memory is sufficient as a minimum function of the memory.

In the cartridge E, the developer accommodated in the developer accommodating portion 44 is gradually consumed with its use for image formation. Then, the developer is consumed until the image of such a quality that the use can satisfy is unable to be formed, so that the cartridge E reaches an end of its operation lifetime.

Therefore, in this embodiment, a remaining developer amount detecting means for detecting a remaining developer amount value of the developer accommodating portion 44 is provided. Further, in the engine controller C, a detected remaining developer amount value is compared with a threshold (predetermined value), for cartridge lifetime prewarning or warning, set in advance. When the remaining developer amount value reaches the threshold, the lifetime prewarning or lifetime warning of the cartridge E is displayed at a displaying portion of an operating panel portion D or at a displaying portion of the host device B. As a result, the user is urged to prepare a (new) cartridge E for replacement or is urged to replace the cartridge E.

As the remaining developer amount detecting means for detecting the remaining developer amount value of the developer accommodating portion 44, various means can be used. In this embodiment, an electrode 46 as the remaining developer amount detecting means for detecting the remaining developer amount value is provided in the neighborhood of the developing roller 41 in the developer accommodating portion 44. When the developer in the developer accommodating portion is gradually consumed, then electrostatic capacity between the developing roller 41 and the electrode 46 is decreased with a decrease of the developer in a space interposed between the developing roller 41 and the electrode 46. That is, there is a correlation between the developer amount in the developer accommodating portion 44 and the above electrostatic capacity.

Therefore, correlation data between the developer amount in the developer accommodating portion 44 and the above electrostatic capacity is stored (held) in advance in a memory 22 provided in the engine controller C. The engine controller C can detect the remaining developer amount value in the developer accommodating portion 44 from the electrostatic capacity measured by the electrode 46 and the above correlation data stored in the memory 22.

The detection (method) of the cartridge lifetime is not limited to a method using the above-described remaining developer amount value detection. In the process cartridge E of the integral type, the cartridge lifetime detection can also be made by detecting a lifetime of the drum 1. A film thickness of the photosensitive layer (charge generating layer) of the drum 1 is gradually decreased by continuous image formation. Therefore, as an example of the detecting means of the drum lifetime (cartridge lifetime), the drum lifetime can be discriminated by detecting an increase of a current value during constant voltage application to the drum 1.

This is because during the constant voltage application, an AC current passing between the drum and the charging means is increased with a decrease in thickness of the drum by the continuous image formation. That is, when the film thickness of the drum is decreased to reach a certain film thickness, drum lifetime discrimination can be made by determining the AC current flowing at that time.

The cartridge lifetime detection can be performed also by other various means such as detection by comparison between an integrated sheet passing number (integrated number of image formation) and a predetermined threshold, detection by comparison between a residual (waste) toner stagnation value of a residual toner accommodating portion and a predetermined threshold in the case where a drum cleaner is provided, and the like detection.

(3) Cartridge Recycling Detecting System

The used (spent) cartridge demounted from the apparatus main assembly A1 by the user on the basis of the lifetime prewarning or lifetime warning of the cartridge E is collected in a recycling factory. Then, in the case where the constituent element (image forming process member) of the collected used cartridge is recyclable, disassembling of the cartridge is performed in a recycling step, so that a recyclable constituent element is demounted. Then, recycling is made as desired and then the constituent element is reused as the constituent element for a new cartridge.

Here, the case where the constituent element of the used cartridge is recyclable means that even when the constituent element is reused as the constituent element for the new cartridge, the constituent element is in a state, in which image defect is not generated during the use, through the lifetime of the cartridge within an operation coverage range.

In the present invention, as described below, with respect to the used cartridge collected in the recycling factory, recycling detection of the constituent element is directly made by the image forming apparatus main assembly in which the cartridge is mounted and used. Further, recycling go/no-go discrimination information or information for performing recycling go/no-go discrimination is stored in the memory 14 of the cartridge E.

Therefore, in the recycling factory, by reading out the recycling go/no-go discrimination information or information for performing recycling go/no-go discrimination stored in the memory 14 of the collected used cartridge E, accurate recycling discrimination of the constituent element can be made. That is, with respect to the constituent element, a recyclable cartridge and a non-recyclable cartridge are accurately screened, so that only the recyclable cartridge can be subjected to a disassembling step.

Accordingly, it is possible to eliminate such an inconvenience that accurate recycling discrimination of the constituent element cannot be made and disassembling of the non-recyclable cartridge is also performed as in a conventional case where the recycling discriminating is made on the basis of the print number information (image formation history information), so that an efficiency of the recycling step can be enhanced.

Figure 4:
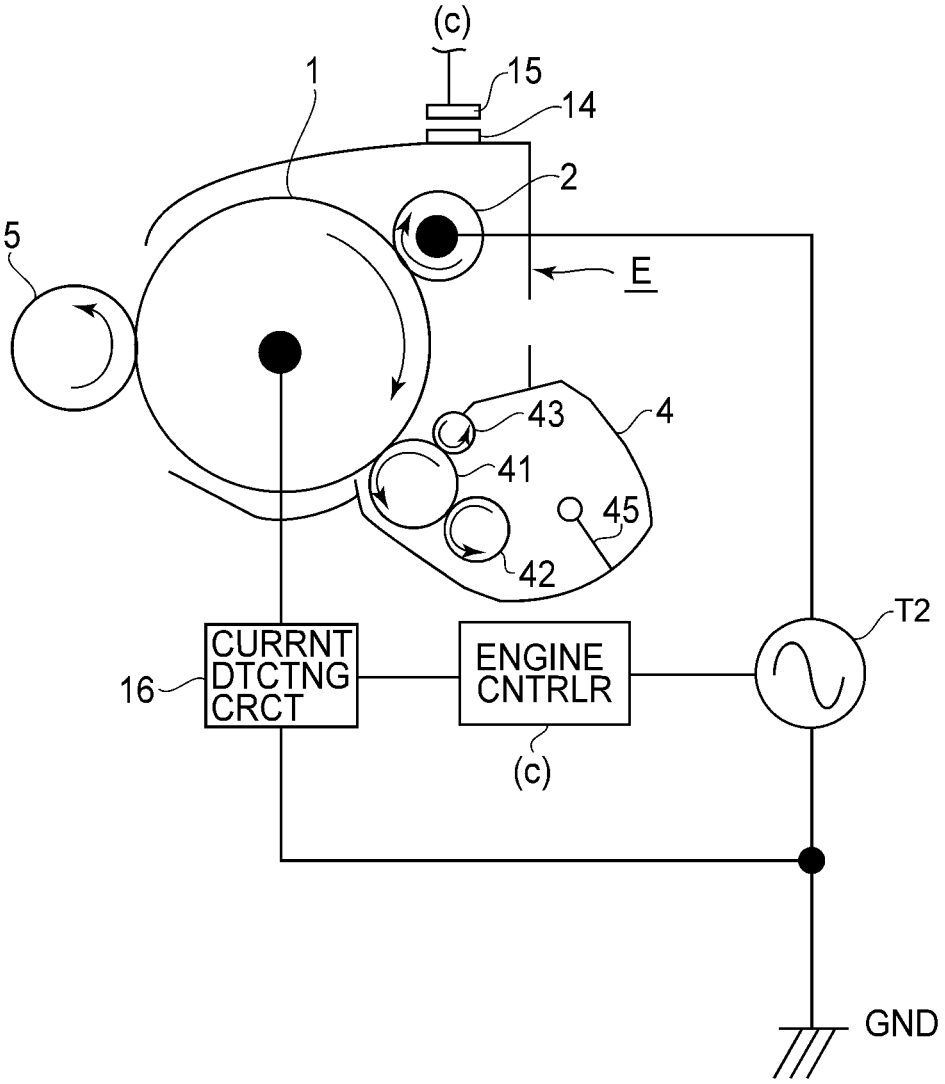
FIG. 4 is a schematic illustration of a current detecting method in Embodiments 1 to 4.

In the following, the recycling detecting system for the cartridge E in this embodiment will be specifically described. In this embodiment, the recycling discrimination with respect to the charging roller 2 as the image forming process member provided to the cartridge E is effected. FIG. 4 is a block diagram of a current detecting system for effecting the recycling discrimination. The apparatus main assembly A1 includes a current detecting circuit 16 as a current detecting means for detecting a value of a current passing through the drum 1 as the image bearing member when the voltage is applied to the charging roller 2 provided in the cartridge E mounted in the apparatus main assembly A1.

The engine controller C as the control means is operable in a recycling go/no-go discrimination mode (recycling discriminating sequence) with respect to the charging roller 2 of the cartridge E mounted in the apparatus main assembly A1. In an operation in this recycling go/no-go discrimination mode, a predetermined charging bias is applied to the charging roller 2 and then a value of a current passing through the drum 1 (the charging roller 2) is detected by the current detecting circuit 16. Then, from the detected current value, whether or not the charging roller 2 can be recycled is discriminated, and its discrimination result is stored in the non-volatile memory 14 of the cartridge E.

The charging bias power source portion T2 is provided in the apparatus main assembly A1 and applies to the charging roller 2 a predetermined charging bias in the form of an AC voltage biased with a DC voltage. When the charging bias is applied, an AC current passes through the charging roller 2 and the drum 1 and flows into the ground (GND). The current detecting circuit 16 extracts only the AC current by a filter circuit (not shown) and converts the AC current into a voltage V. The thus-obtained voltage V is inputted into the engine controller C and then current detection is made by the CPU 21.

By controlling an AC voltage Vp-p of the charging bias by the CPU 21 so that the voltage V becomes constant, that a certain current always flows between the charging roller 2 and the drum 1. Therefore, the value of the current flowing between the charging roller 2 and the drum 1 under setting of the AC voltage Vp-p can be detected.

Parts (a) and (b) of FIG. 5 show a recycling go/no-go discrimination detecting method of the charging roller 2 provided in the cartridge E, in which (a) is a graph in the case where the charging roller 2 is recyclable, and (b) of a graph in the case where the charging roller 2 is not recyclable. In (a) and (b) of FIG. 5, the abscissa represents the lifetime of the drum 1, and the ordinate represents the detected current value, of the current passing through the charging roller 2, detected by the method described with reference to FIG. 4.

The engine controller C executes the operation in the recycling go/no-go discrimination mode with respect to the charging roller 2 when the lifetime of the drum 1 reaches 100% (set as the end of the lifetime of the drum). That is, to the charging roller 2, a predetermined voltage is applied for a predetermined time and then the value of the current passing through the drum 1 is detected by the current detecting circuit. Then, from the detected current value, whether or not the charging roller 2 can be recycled is discriminated, and its discrimination result is stored in the non-volatile memory 14 of the cartridge E.

More specifically, the value of the current passing through the charging roller 2 when the certain voltage of the charging bias is applied to the charging roller 2 is monitored by the CPU 21, and change levels (Δ1, Δ2) of the current are detected by the CPU 21.

The engine controller C effects, after the detection of the current change levels (Δ1, Δ2), the recycling go/no-go discrimination of the charging roller 2 depending on the change levels (Δ1, Δ2). Further, in the case where the charging roller 2 is recyclable, the charging roller 2 is subjected to recycling level discrimination as to whether the charging roller 2 is recyclable in which cartridge of a long-lifetime cartridge and a short-lifetime cartridge during next recycling. Then, with respect to the charging roller 2, a result of the above recycling go/no-go discrimination and a result of the above recycling level discrimination in the case where the charging roller 2 is recyclable are stored in the non-volatile memory 14 of the cartridge E.

The charging roller 2 is deteriorated principally due to influences of left-standing, contamination and energy (electric power) supply. Of these, with a larger influence on the charging roller 2 by the energy supply deterioration, a degree of the current value change in the case where the voltage is continuously applied becomes larger. When the energy supply to the charging roller 2 is continued, a current value change Δ is generated and converges with a lapse of time. Further, a non-energy supply state is continued, the current value is returned to that in a state before the energy supply. With a shorter lifetime state of the charging roller 2, the charging roller 2 is influenced with a larger degree by the energy supply deterioration. For that reason, when the energy is supplied to the charging roller 2, the current value change Δ becomes large. An application time of the certain voltage is of no problem when it is an arbitrary time, so long as it is not less than a time in which the current value change Δ can be detected.

A relationship between the charging roller current value and improper charging is shown in (a) and (b) of FIG. 6. From (a) of FIG. 6, a roller current change amount Δ1 by an application time Ta of the voltage to the charging roller 2 is measured. From its result, the current value change in the application time is obtained and then a current change amount Δ2 in the lifetime of the cartridge used for the recycling is estimated, and thereafter the recycling discrimination is made depending on whether or not the current value is less than a recycling discrimination threshold. At the current value change amount Δ2 estimated from Δ1, the current value in the cartridge lifetime is below the recycling discrimination threshold, so that the recycling is discriminated as "NG".

On the other hand, from (b) of FIG. 6, a roller current change amount Δ3 by an application time Tb of the voltage to the charging roller 2 is measured. From its result, the current value change in the application time is obtained and then a current change amount in the lifetime of the cartridge used for the recycling can be estimated as Δ4. At the current value change amount Δ4, the current value in the cartridge lifetime exceeds the recycling discrimination threshold, so that the recycling is discriminated as "OK".

FIG. 7 shows a timing chart of a sequence of the operation in the recycling go/no-go discrimination mode of the charging roller 2 in this embodiment. The timing chart relates to image formation by the cartridge E. In this embodiment, the engine controller C executes the operation in the recycling go/no-go discrimination mode when it discriminates that the lifetime of the cartridge reaches the end on the basis of the rotation time of the drum 1.

When the engine controller C detects that the lifetime of the drum 1 reaches 100%, the engine controller C continuously rotates the drum 1 and applies the charging AC voltage concurrently even after the end of the image formation. The engine controller C detects the value of the current passing through the charging roller 2 during the charging AC voltage application and after the current detection, and stops the operation of the image forming apparatus A by turning off the charging AC voltage (application) and the rotation of the drum 1.

Here, calculation of the drum lifetime will be described on the basis of description in JP-A 2006-106692. As information relating to the cartridge use amount, information on drum use amount calculated based on the drum rotation time is used. This corresponds to a use amount of a photosensitive drum computed on the basis of a damage index of the photosensitive drum disclosed in Japanese Patent No. 3285785.

In the memory in the cartridge, pieces of information such as cartridge drive time information T, drum use amount operational expression coefficient information ϕ as weighting coefficient for computing the photosensitive drum use amount, photosensitive drum use amount threshold information α, and information showing a table for setting an image forming condition correspondingly to the photosensitive drum use amount threshold information α.

The photosensitive drum use amount threshold information α and the drum use amount operational expression coefficient information ϕ are stored in the memory during shipping of the cartridge. These values change depending on sensitivity of the drum, a drum material, a contact pressure of a cleaning blade, and an electric characteristic of the charging roller and therefore are stored in the memory of individual cartridge, and then the cartridge is shipped.

When the print signal is received by the image forming apparatus main assembly, the cartridge is driven by a photosensitive member rotation instruction portion, so that an image forming process is started. In this case, the drum use amount is calculated in the following manner.

An integrated value of photosensitive drum rotation time data (corresponding to the above-described cartridge drive time information T) from the photosensitive member rotation instruction portion is B. An integrated value of charging bias application time data from a charging bias application time detecting portion is A. By a conversion formula $D=A+B\times\phi$ using the weighting coefficient ϕ read from the memory, a drum use amount D is calculated by a computing portion and then is integrated and stored in a main assembly memory for main assembly storage.

The photosensitive drum rotation time data and the charging bias application time data are stored in the memory at any time, and the data computing of the drum use amount is performed in real time when the drive of the photosensitive drum is stopped. In place of storage of the photosensitive drum rotation time data and the charging bias application time data in the memory, the drum use amount D as the result of the computing may also be written in the memory.

From the photosensitive drum lifetime warranted by a manufacturer, a predetermined drum use amount W0 is calculated and stored in the memory. A drum use amount W1 during use of the cartridge is stored in the memory by the above-described method. Here, the drum lifetime is defined as: (drum lifetime)=(W1/W0)×100(%). That is, a maximum integrated rotation time W0 predetermined with respect to the drum 1 is the photosensitive drum lifetime of 100%. A ratio of the integrated rotation time of the photosensitive drum during the use of the cartridge to the maximum integrated rotation time W0 is the drum lifetime during the use of the cartridge.

Figure 1:
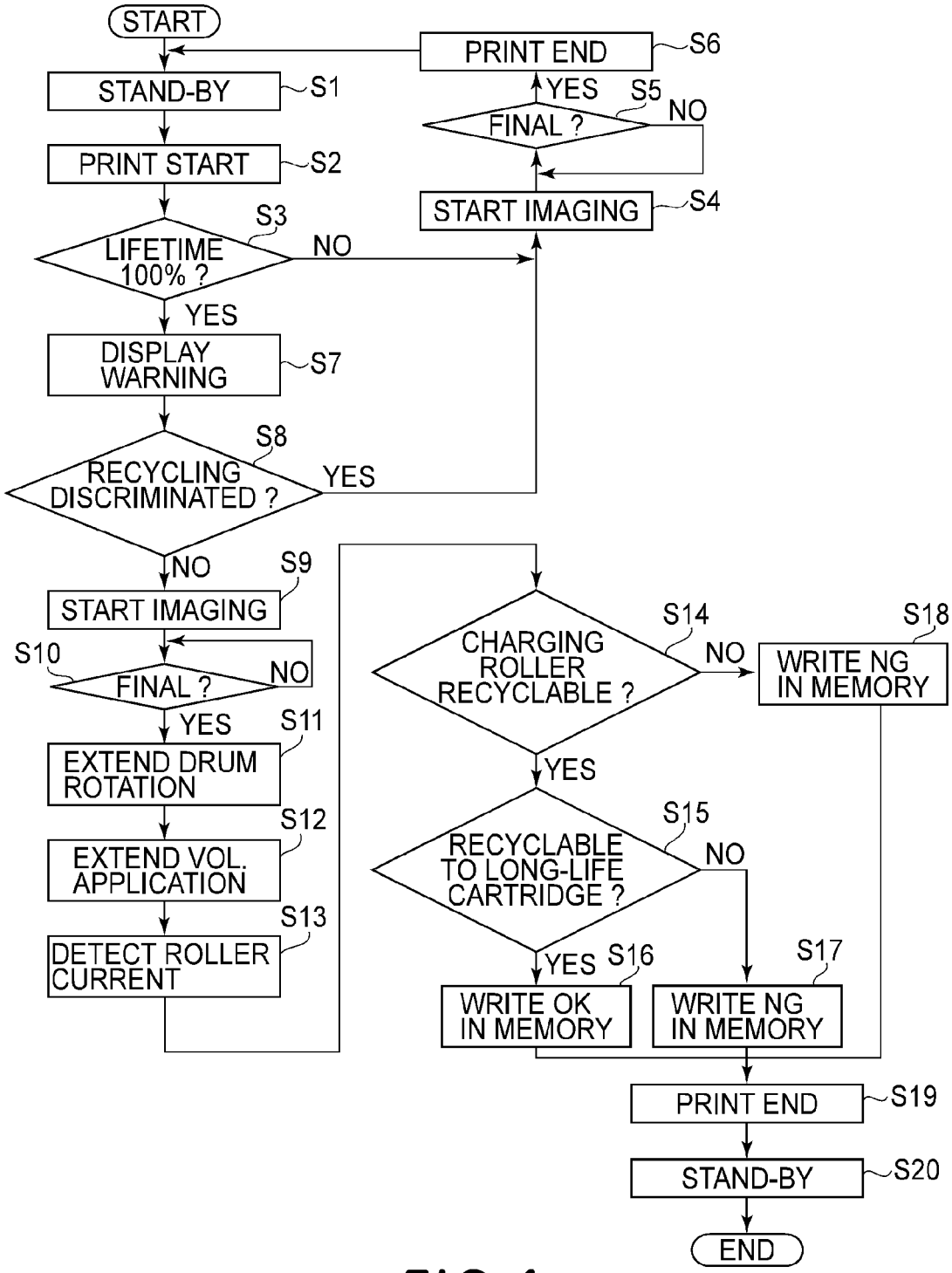
FIG. 1 is a control flow chart in Embodiment 1.

FIG. 1 shows a control flow chart of the image forming apparatus in this embodiment. In a stand-by state (state in which a main motor is stopped and the image forming apparatus waits for input of a printer command) of the image forming apparatus (step S1), the engine controller C receives the printer command. Then, the engine controller C actuates the main motor of the image forming apparatus to start a printing operation (S2: pre-rotation step as a preparation operation before image formation).

The engine controller C discriminates, at the time of the print start, whether or not the drum lifetime of the cartridge E mounted in the apparatus main assembly A1 is 100% by the photosensitive drum lifetime detecting means as described above (S3).

When the drum lifetime does not reach 100%, the image formation of an inputted print job is started. Then, when printing of a predetermined number of sheets is effected, the printing is ended (post-rotation step as an ending operation after the image formation) and the main motor is turned off to place the image forming apparatus in the stand-by state (S4 to S6 and S1).

Further, in step S3, in the case where the drum lifetime is discriminated as 100%, the engine controller C displays lifetime prewarning or lifetime warning of the cartridge E at the displaying portion of the operating panel portion D or at the displaying portion of the host device B (S7). Further, whether or not the charging roller 2 has already been subjected to the recycling go/no-go discrimination is discriminated (S8). When the charging roller 2 has already been subjected to the recycling go/no-go discrimination, the engine controller C starts the image formation of the inputted print job and then ends the printing when the printing of a predetermined number of sheets is effected, and thereafter turns off the main motor to place the image forming apparatus in the stand-by state (S4 to S6 and S1).

In step S8, when the charging roller 2 has not been subjected to the recycling go/no-go discrimination, the engine controller C starts the image formation of the inputted print job and then executes printing of a predetermined number of sheets (S9 and S10). Then, the drum rotation after end of the printing of the predetermined number of sheets is extended (S11). Then, the engine controller C executes the operation in the recycling go/no-go discrimination mode with respect to the charging roller 2.

That is, after the image formation (S10), the engine controller 10 extends the rotation of the drum (S11) and concurrently extends the application of the charging AC voltage to the charging roller 2 (S12). Then, detection of the current passing through the charging roller 2 is made by the current detecting circuit 16 (S13). From a result of the detected current value, the current value change level Δ of the charging roller 2 is detected to discriminate whether or not the charging roller 2 is recyclable (S14).

In the case where the discrimination that the charging roller 2 is not recyclable is made in step S14, recycling NG with respect to the charging roller 2 is written in the non-volatile memory 14 of the cartridge E (S18). Even when the charging roller 2 discriminated as being not recyclable is reused in a short-lifetime cartridge, the charging roller 2 is in a state in which the lifetime of the cartridge in an operation coverage range cannot be warranted. Then, the printing is ended (post-rotation step) (S19), and the main motor is turned off to place the image forming apparatus in the stand-by state (S20).

Further, in step S14, in the case where the charging roller 2 is discriminated as being recyclable, on the basis of the current value change level Δ, whether the charging roller 2 is recyclable for which cartridge of a long-lifetime cartridge and the short-lifetime cartridge is discriminated (S15).

In the case where the charging roller 2 is discriminated as being recyclable for the long-lifetime cartridge, its information is written in the non-volatile memory 14 of the cartridge E (S16). Then, the printing is ended (post-rotation step) (S19), and the main motor is turned-off to place the image forming apparatus in the stand-by state (S20).

Further, in the case where the charging roller 2 is discriminated as being recyclable for the short-lifetime cartridge, its information is written in the non-volatile memory 14 of the cartridge E (S17). Then, the printing is ended (post-rotation step) (S19), and the main motor is turned-off to place the image forming apparatus in the stand-by state (S20).

In the above steps, steps S11 to S18 are performed as the operation in the recycling go/no-go discrimination mode of the charging roller 2 as the image forming process member included in the cartridge E.

Thus, in the image forming apparatus main assembly A1 in which the cartridge E is mounted, the recycling detection of the constituent element is directly made and then the recycling go/no-go discrimination information is stored in the non-volatile memory of the cartridge E, so that accurate recycling discrimination of the constituent element is effected.

That is, by detecting the current passing through the charging roller 2 when the certain voltage is applied to the charging roller 2, it becomes possible to effect the recycling go/no-go discrimination of the charging roller 2 with reliability. Then, the recycling go/no-go discrimination information of the charging roller 2 is written in the non-volatile memory 14 of the cartridge E, so that there is no need to disassemble the cartridge in the factory and then to discriminate the necessity or unnecessity of the recycling. Further, when the recycling go/no-go discrimination is stored, it becomes possible to eliminate the recycling discriminating step (e.g., a step of reading the image forming information from the non-volatile memory to discriminate the necessity or unnecessity of the recycling) in the factory.

In the above, as the current detecting means of the charging roller 2, the method using the AC voltage is described, but the means may also be used of the DC voltage or the like and thus is not limited to that in this embodiment so long as the means has a similar constitution capable of detecting the current value of the charging roller 2.

With respect to timing of the recycling go/no-go discrimination of the charging roller 2, the method effected by detecting the photosensitive drum lifetime is described, but the timing is not limited to that in this embodiment but may also be timing of remaining developer amount value detection, timing of an integrated value of the number of passing sheets, and the like timing so long as at the timing, the lifetime of the cartridge E is similarly detectable.

The lifetime of the recyclable cartridge is discriminated as the two types (long and short) from the current value change level Δ, but the lifetime discrimination is not limited to that in this embodiment but may also be effected as one type or three or more types, or the like types.

Embodiment 2

In Embodiment 1, the charging roller current detection timing for the recycling go/no-go discrimination was taken as the end of the lifetime of the cartridge E when the lifetime of the drum 1 reached its end. On the other hand, in this embodiment, a constitution in which the charging roller detection is effected at a point of timing set depending on the drum lifetime to obtain the current value change is employed. That is, the operation in the recycling go/no-go discrimination mode is periodically performed in an operation period from a brand-new state of the cartridge E to the end of the lifetime of the cartridge E, so that a slope of the detected current values. The periodical operation in the recycling go/no-go discrimination mode is executed at timing depending on progression of the rotation time of the drum 1. In this embodiment, repeated portions of those in Embodiment 1 will be omitted from description.

Parts (a) and (b) of FIG. 8 show a recycling go/no-go discrimination detecting method of the charging roller 2 provided in the cartridge E, in which (a) is a graph in the case where the charging roller 2 is recyclable, and (b) of a graph in the case where the charging roller 2 is not recyclable. In (a) and (b) of FIG. 8, the abscissa represents the lifetime of the drum 1, and the ordinate represents the detected current value, of the current passing through the charging roller 2, detected by the method described with reference to FIG. 4.

In the latter half of the lifetime of the drum 1, at a plurality of set points, i.e., two points of 90% and 100% in photosensitive drum lifetime in this embodiment, the certain voltage of the charging bias is applied to the charging roller 2, and then the value of the current passing through the charging roller 2 at that time is detected by the CPU 21.

Current values X90(*a*) and X90(*b*) detected at the time of the drum 1 lifetime of 90% are written into the non-volatile memory 14 of the cartridge E by the CPU 21. Then, when current values X100(*a*) and X100(*b*) is detected at the time of the drum 1 lifetime of 100%, the current values X90(*a*) and X90(*b*) detected at the time of the drum 1 lifetime of 90% is read from the non-volatile memory 14 by the CPU 21. Then, from the two points of the current values X100(*a*) and X100(*b*) detected at the time of the drum 1 lifetime of 100%, a slope of the current change is detected.

The engine controller C effects, after the detection of the slope of the current change, the recycling go/no-go discrimination of the charging roller 2 depending on the slope of the current value change. Further, in the case where the charging roller 2 is recyclable, the charging roller 2 is subjected to recycling level discrimination as to whether the charging roller 2 is recyclable in which cartridge of a long-lifetime cartridge and a short-lifetime cartridge during next recycling.

FIG. 9A and FIG. 9B show a control flow chart of the image forming apparatus in this embodiment. In a stand-by state (state in which a main motor is stopped and the image forming apparatus waits for input of a printer command) of the image forming apparatus (step S1), the engine controller C receives the printer command. Then, the engine controller C actuates the main motor of the image forming apparatus to start a printing operation (S2: pre-rotation step as a preparation operation before image formation).

The engine controller C discriminates, at the time of the print start, whether or not the drum lifetime of the cartridge E mounted in the apparatus main assembly A1 is 90% by the photosensitive drum lifetime detecting means as described above (S3').

When the drum lifetime does not reach 90%, the image formation of an inputted print job is started. Then, when printing of a predetermined number of sheets is effected, the printing is ended (post-rotation step as an ending operation after the image formation) and the main motor is turned off to place the image forming apparatus in the stand-by state (S4 to S6 and S1).

Further, in step S3, in the case where the drum lifetime is discriminated as 90%, the engine controller C discriminates whether or not the charging roller 2 has already been subjected to the current value detection at the time of the drum lifetime of 90% (S7'). Further, when the charging roller 2 has already been subjected to the current value detection, whether or not the drum lifetime is 100% is discriminated (S8'). When the drum lifetime does not reach 100%, the engine controller C starts the image formation of the inputted print job and then ends the printing when the printing of a predetermined number of sheets is effected, and thereafter turns off the main motor to place the image forming apparatus in the stand-by state (S4 to S6 and S1).

In step S7, when the charging roller 2 has not been subjected to the current value detection at the time of the drum lifetime of 90%, the engine controller C starts the image formation of the inputted print job and then executes printing of a predetermined number of sheets (S9 and S10). Then, the drum rotation after end of the printing of the predetermined number of sheets is extended (S11). Then, the engine controller C executes the current value detection at the time of the drum lifetime of 90% with respect to the charging roller 2.

That is, after the image formation (S10), the engine controller 10 extends the rotation of the drum 1 (S11) and concurrently extends the application of the charging AC voltage to the charging roller 2 (S12). Then, detection of the current passing through the charging roller 2 (current value detection at the time of the drum lifetime of 90%) is made by the current detecting circuit 16 (S13). The detected current value at the time of the drum lifetime of 90% is written in the non-volatile memory 14 of the cartridge E (S14'), and the printing is ended (post-rotation step) (S15'), and then the main motor is turned off to place the image forming apparatus in the stand-by state (S16').

In step S8, in the case where the drum lifetime is discriminated as being 100%, the engine controller C starts the image formation of the inputted print job and then executes printing of a predetermined number of sheets (S17' and S18'). Then, the drum rotation after end of the printing of the predetermined number of sheets is extended (S19'). Then, the engine controller C executes the current value detection at the time of the drum lifetime of 100% with respect to the charging roller 2.

That is, after the image formation (S18'), the engine controller 10 extends the rotation of the drum 1 (S19') and concurrently extends the application of the charging AC voltage to the charging roller 2 (S20'). Then, detection of the current passing through the charging roller 2 (current value detection at the time of the drum lifetime of 100%) is made by the current detecting circuit 16 (S21).

Then, the current value detected at the time of the drum lifetime of 90% is read from the non-volatile memory 14 (S22'), and a slope of the current value charge is detected from the current values at the times of the drum lifetimes of 90% and 100% (S23), and then whether or not the charging roller 2 is recyclable (S24).

In the case where the discrimination that the charging roller 2 is not recyclable is made in step S24, recycling NG with respect to the charging roller 2 is written in the non-volatile memory 14 of the cartridge E (S25). Even when the charging roller 2 discriminated as being not recyclable is reused in a short-lifetime cartridge, the charging roller 2 is in a state in which the lifetime of the cartridge in an operation coverage range cannot be warranted. Then, the printing is ended (post-rotation step) (S15), and the main motor is turned off to place the image forming apparatus in the stand-by state (S16).

Further, in step S24, in the case where the charging roller 2 is discriminated as being recyclable, on the basis of the current value change level Δ, whether the charging roller 2 is recyclable for which cartridge of a long-lifetime cartridge and the short-lifetime cartridge is discriminated (S26).

In the case where the charging roller 2 is discriminated as being recyclable for the long-lifetime cartridge, its information is written in the non-volatile memory 14 of the cartridge E (S27). Then, the printing is ended (post-rotation step) (S15), and the main motor is turned-off to place the image forming apparatus in the stand-by state (S16).

Further, in the case where the charging roller 2 is discriminated as being recyclable for the short-lifetime cartridge, its information is written in the non-volatile memory 14 of the cartridge E (S28). Then, the printing is ended (post-rotation step) (S15), and the main motor is turned-off to place the image forming apparatus in the stand-by state (S16).

In the above steps, steps S11 to S18 are performed as the operation in the recycling go/no-go discrimination mode of the charging roller 2 as the image forming process member included in the cartridge E.

Also in this embodiment, in the image forming apparatus main assembly A1 in which the cartridge E is mounted, the recycling detection of the constituent element is directly made and then the recycling go/no-go discrimination information is stored in the non-volatile memory of the cartridge E, so that accurate recycling discrimination of the constituent element is effected.

That is, by detecting the current passing through the charging roller 2 when the certain voltage is applied to the charging roller 2, it becomes possible to effect the recycling go/no-go discrimination of the charging roller 2 with reliability.

In the above, as the current detecting means of the charging roller 2, the method using the AC voltage is described, but the means may also be used of the DC voltage or the like and thus is not limited to that in this embodiment so long as the means has a similar constitution capable of detecting the current value of the charging roller 2.

With respect to timing of the recycling go/no-go discrimination of the charging roller 2, the method effected by detecting the photosensitive drum lifetime is described, but the timing is not limited to that in this embodiment but may also be timing of remaining developer amount detection, timing of an integrated number of passing sheets, and the like timing so long as at the timing, the lifetime of the cartridge E is similarly detectable.

The lifetime of the recyclable cartridge is discriminated as the two types (long and short) from the current value change level Δ, but the lifetime discrimination is not limited to that in this embodiment but may also be effected as one type or three or more types, or the like types.

Embodiment 3

In Embodiment 1, the current detection timing of the charging roller 2 subjected to the recycling go/no-go discrimination was discriminated from the photosensitive drum lifetime. On the other hand, in this embodiment, a constitution in which a remaining developer amount in the cartridge E is detected and then the current detection of the charging roller 2 is effected at timing when the remaining developer amount becomes zero to obtain the current value change is employed. In this embodiment, repeated portions of those in Embodiment 1 will be omitted from description.

As a remaining developer amount detecting means for detecting the remaining developer amount in the developer accommodating portion 44 of the developing device 4 included in the cartridge E, various means can be used. In this embodiment, an electrode (plate) 46 (FIG. 2) as the remaining developer amount detecting means is provided in the neighborhood of the developing roller 41 to which the developing bias to be applied. When the developer in the developer accommodating portion 44 is gradually consumed, with a decrease of the developer in a space interposed between the developing roller 41 and the electrode 46, also electrostatic capacity between the developing roller 41 and the electrode 46 is decreased. That is, there is a correlation between the developer amount in the developer accommodating portion 44 and the above electrostatic capacity.

Therefore, correlation data between the developer amount in the developer accommodating portion 44 and the electrostatic capacity is held (stored) in advance. The engine controller C can detect the remaining developer amount in the developer accommodating portion 44 from the correlation data, held in the memory 22, measured by the electrode 46.

Parts (a) and (b) of FIG. 10 show a recycling go/no-go discrimination detecting method of the charging roller 2 provided in the cartridge E, in which (a) is a graph in the case where the charging roller 2 is recyclable, and (b) is a graph in the case where the charging roller 2 is not recyclable. In (a) and (b) of FIG. 10, the abscissa represents progression of the remaining developer amount, and the ordinate represents the detected current value, of the current passing through the charging roller 2, detected by the method described with reference to FIG. 4. When the remaining developer amount becomes 0%, the printing cannot be effected by using the cartridge E and therefore the cartridge E is discriminated as reaching the end of its lifetime, so that a recycling discriminating sequence of the charging roller 2 in which the charging bias is applied for a predetermined time is started.

In the charging roller recycling discriminating sequence, the value of the current passing through the charging roller 2 when the certain voltage of the charging bias is applied to the charging roller 2 is monitored by the CPU 21, and change levels (Δ1, Δ2) of the current are detected by the CPU 21.

After the detection of the current change levels (Δ1, Δ2), the recycling go/no-go discrimination is effected depending on the change levels (Δ1, Δ2). Further, in the case where the charging roller 2 is recyclable, the charging roller 2 is subjected to recycling level discrimination as to whether the charging roller 2 is recyclable in which process cartridge of a long-lifetime cartridge and a short-lifetime cartridge during next recycling.

FIG. 11 shows a control flow chart of the image forming apparatus in this embodiment. In this embodiment, in comparison with the control flow chart of FIG. 1 in Embodiment 1, the discrimination content of the step S3" in the control flow chart of FIG. 1 was changed to discriminate as to whether or not the remaining developer amount value is 0%. Other control steps are the same as those in the control flow chart of FIG. 1.

Thus, in the image forming apparatus main assembly A1 in which the cartridge E is mounted, the recycling detection of the constituent element is directly made and then the recycling go/no-go discrimination information is stored in the non-volatile memory of the cartridge E, so that accurate recycling discrimination of the constituent element is effected.

Also in this embodiment, by detecting the current passing through the charging roller 2 when the certain voltage is applied to the charging roller 2, it becomes possible to effect the recycling go/no-go discrimination of the charging roller 2 with reliability.

In the above, as the current detecting means of the charging roller 2, the method using the AC voltage is described, but the means may also be used of the DC voltage or the like and thus is not limited to that in this embodiment so long as the means has a similar constitution capable of detecting the current value of the charging roller 2.

With respect to timing of the recycling go/no-go discrimination of the charging roller 2, the method effected by detecting the photosensitive drum lifetime is described, but the timing is not limited to that in this embodiment but may also be timing of remaining developer amount detection, timing of an integrated number of passing sheets, and the like timing so long as at the timing, the lifetime of the cartridge E is similarly detectable.

The lifetime of the recyclable cartridge is discriminated as the two types (long and short) from the current value change level Δ, but the lifetime discrimination is not limited to that in this embodiment but may also be effected as one type or three or more types, or the like types.

Embodiment 4

In Embodiments 1 and 2, the charging roller current detection timing for the recycling go/no-go discrimination was discriminated from the photosensitive drum lifetime. In Embodiment 3, the charging roller current detecting timing when the recycling go/no-go discrimination was made was the time when the remaining developer amount became zero. On the other hand, in this embodiment, a constitution in which the charging roller detection is effected at a point of timing set depending on the remaining developer amount to obtain the current value change is employed. In this embodiment, repeated portions of those in Embodiment 1 will be omitted from description.

Parts (a) and (b) of FIG. 12 are schematic views showing a recycling go/no-go discrimination detecting method of the charging roller 2 provided in the cartridge E, in which (a) is a graph in the case where the charging roller 2 is recyclable, and (b) of a graph in the case where the charging roller 2 is not recyclable. In (a) and (b) of FIG. 12, the abscissa represents the remaining developer amount value, and the ordinate represents the detected current value, of the current passing through the charging roller 2, detected by the method described with reference to FIG. 4.

When the remaining developer amount becomes small at a plurality of set points, i.e., two points of 10% and 0% in remaining developer amount value in this embodiment, the certain voltage of the charging bias is applied to the charging roller 2, and then the value of the current passing through the charging roller 2 at that time is detected by the CPU 21.

Current values X10(*a*) and X10(*b*) detected at the time of the remaining developer amount value of 10% are written into the non-volatile memory 14 of the cartridge E by the CPU 21. Then, when current values X0(*a*) and X0(*b*) are detected at the time of the remaining developer amount value of 0%, the current values X10(*a*) and X10(*b*) detected at the time of the remaining developer amount value of 10% are read from the non-volatile memory 14 by the CPU 21. Then, from the two points of the current values X0(*a*) and X0(*b*) detected at the time of the remaining developer amount value of 0%, a slope of the current change is detected.

After the detection of the slope of the current change, the recycling go/no-go discrimination of the charging roller 2 depending on the slope of the current value change, and recycling level discrimination as to whether the charging roller 2 is recyclable in which cartridge of a long-lifetime cartridge and a short-lifetime cartridge during next recycling are effected.

FIG. 13A and FIG. 13B show a control flow chart of the image forming apparatus in this embodiment. In this embodiment, in comparison with the control flow chart of FIG. 9A and FIG. 9B in Embodiment 3, the contents of the following five steps are changed, and other control steps are the same as those in the control flow chart of FIG. 9A and FIG. 9B.

The discrimination content of the step S3''' in Embodiment 3 was changed to discriminate whether or not the remaining developer amount was 10%. The discrimination content of the step S7 was changed to discriminate whether or not the current value at the time of the remaining developer amount of 10% had already been detected. The discrimination content of the step S8'' was changed to discriminate whether or not the remaining developer amount was 0%. The control content of the step S22 was changed to reading, from the non-volatile memory, of the current value at the time of the remaining developer amount of 10%. Further, the control content of the step S23 was changed to detection of the slope of the current change from the current values at the times of the remaining developer amounts of 10% and 0%.

Embodiment 5

In Embodiments 1 to 4, whether or not the charging roller 2 was recyclable was discriminated from the current passing through the charging roller and the photosensitive drum. On the other hand, in this embodiment, a constitution in which a discharging current (discharging amount) which is a discharging component between the charging roller and the photosensitive drum is detected is employed. In this embodiment, repeated portions of those in Embodiment 1 will be omitted from description.

FIG. 14 is a graph showing a discharging current detecting method in this embodiment. In FIG. 14, the abscissa represents an applied voltage value of the charging bias power source S2, and the ordinate represents a value of the current, passing between the charging roller 2 and the drum 1, detected by the method described with reference to FIG. 4. In order to detect the discharging current as the discharging component, a plurality of voltages (a to f in FIG. 14) are applied from the component power source S2. At that time, a relationship between the voltage and the current in a non-discharging region (a to c) between the charging roller 2 and the drum 1 is a linear relationship.

When the electric discharge is started between the charging roller 2 and the drum 1, a slope (d to f) when the voltage is increased becomes large compared with that in the non-discharging region. Based on this characteristic, by obtaining the slope in each of the non-discharging region (a to c) and a discharging region (d to f) by the CPU 21, it is possible to detect a discharging current (Ia). This discharging current (Ia) used in the normal image formation is set at a value which is not more than a discharging control (Iamax) at a maximum output enable voltage value of the image forming apparatus.

Parts (a) and (b) of FIG. 15 are schematic views showing a recycling go/no-go discrimination detecting method of the charging roller 2 provided in the cartridge E, in which (a) is a graph in the case where the charging roller 2 is recyclable, and (b) is a graph in the case where the charging roller 2 is not recyclable. In (a) and (b) of FIG. 15, the abscissa represents the lifetime of the drum 1, and the ordinate represents the detected discharging current value, between the charging roller 2 and the drum 1, detected by the method described with reference to FIG. 14.

When the lifetime of the drum 1 reaches 100% (set as the end of the drum lifetime), the cartridge E is discriminated as reaching the end of its lifetime, and then the recycling discriminating sequence of the charging roller 2 in which the plurality of voltages are applied for a desired time from the developing bias power source T4. In the charging roller recycling discriminating sequence, the current passing between the charging roller 2 and the drum 1 when the plurality of desired voltages as the charging bias from non-discharging voltages to discharging voltages is detected by the CPU 21.

Then, by the CPU 21, the discharging current value (Iamax) at the maximum output enable voltage value of the image forming apparatus is calculated (as described with reference to FIG. 14). The calculated discharging current value is monitored by the CPU 21, and change levels (Δ1,Δ2) of the discharging current are detected by the CPU 21.

After the detection of the discharging current change levels (Δ1, Δ2), the recycling go/no-go discrimination of the charging roller 2 is effected depending on the change levels (Δ1, Δ2). Further, in the case where the charging roller 2 is recyclable, the charging roller 2 is subjected to recycling level discrimination as to whether the charging roller 2 is recyclable in which cartridge of a long-lifetime cartridge and a short-lifetime cartridge during next recycling.

FIG. 16 shows a control flow chart of the image forming apparatus in this embodiment. In this embodiment, in comparison with the control flow chart of FIG. 1 in Embodiment 1, the contents of the following four steps are changed, and other control steps are the same as those in the control flow chart of FIG. 1.

The control content of the step S12 in Embodiment 1 was changed to application of a plurality of charging voltages (AC voltages). The control content of the step S13' was changed to detection of the discharging current between the charging roller and the photosensitive drum. The discrimination content of the step S14 was changed to discrimination as to whether or not the charging roller was recyclable from the change level Δ of the discharging current value. Further, the discrimination content of the step S15 was changed to discrimination as to whether or not the charging roller was recyclable for a long-lifetime cartridge from the change level Δ of the discharging current value.

As described above, it becomes possible to effect the recycling go/no-go discrimination of the charging roller 2 by detecting the current, by the CPU 21, passing between the charging roller 2 and the drum 1 when the plurality of desired voltages as the charging bias from the non-discharging voltages to the discharging voltages.

As the discharging current detecting means of the charging roller 2, the method using the AC voltage is described, but the means may also be used of the DC voltage or the like and thus is not limited to that in this embodiment so long as the means has a similar constitution capable of detecting the discharging current value of the charging roller 2.

With respect to timing of the recycling go/no-go discrimination of the charging roller 2, the method effected by detecting the photosensitive drum lifetime is described, but the timing is not limited to that in this embodiment but may also be timing of remaining developer amount detection, timing of an integrated number of passing sheets, and the like timing so long as at the timing, the lifetime of the cartridge E is similarly detectable.

The lifetime of the recyclable cartridge is discriminated as the two types (long and short) from the current value change level Δ, but the lifetime discrimination is not limited to that in this embodiment but may also be effected as one type or three or more types, or the like types.

As the discharging current detecting means of the charging roller 2, the discharging current at the time of application of the maximum output enable voltage of the charging bias is detected but may also be a means for detecting the discharging current during the image formation, and the like means, and thus the discharging current recycling means is not limited to that in this embodiment.

Embodiment 6

In Embodiments 1 to 4, whether or not the charging roller 2 was recyclable was discriminated from the current passing between the charging roller and the photosensitive drum. In Embodiment 5, the charging roller discharging current detection timing was the time, as the end of the cartridge lifetime, when the photosensitive drum reached the end of its lifetime. On the other hand, in this embodiment, a constitution in which the discharge current as the discharging component between the charging roller and the drum is detected after the remaining developer amount is detected and the developer is used is employed. In this embodiment, repeated portions of those in Embodiment 1 will be omitted from description.

Parts (a) and (b) of FIG. 17 are schematic views showing a recycling go/no-go discrimination detecting method of the charging roller 2 provided in the cartridge E, in which (a) is a graph in the case where the charging roller 2 is recyclable, and (b) of a graph in the case where the charging roller 2 is not recyclable. In (a) and (b) of FIG. 17, the abscissa represents the remaining developer amount value, and the ordinate represents the detected discharging current value, between the charging roller 2 and the drum 1, detected by the method described with reference to FIG. 14.

When the remaining developer amount value becomes 0%, the cartridge E is discriminated as reaching the end of its lifetime since the printing cannot be effected by using the cartridge E, and then the recycling discriminating sequence of the charging roller 2 in which the plurality of voltages are applied for a desired time from the developing bias power source T4. In the charging roller recycling discriminating sequence, the current passing between the charging roller 2 and the drum 1 when the plurality of desired voltages as the charging bias from non-discharging voltages to discharging voltages is detected by the CPU 21.

Then, by the CPU 21, the discharging current value (Iamax) at the maximum output enable voltage value of the image forming apparatus is calculated (as described with reference to FIG. 14). The calculated discharging current value is monitored by the CPU 21, and change levels (Δ1,Δ2) of the discharging current are detected by the CPU 21.

After the detection of the discharging current change levels (Δ1, Δ2), the recycling go/no-go discrimination of the charging roller 2 is effected depending on the change levels (Δ1, Δ2). Further, in the case where the charging roller 2 is recyclable, the charging roller 2 is subjected to recycling level discrimination as to whether the charging roller 2 is recyclable in which cartridge of a long-lifetime cartridge and a short-lifetime cartridge during next recycling.

FIG. 11 shows a control flow chart of the image forming apparatus in this embodiment. In this embodiment, in comparison with the control flow chart of FIG. 16 in Embodiment 5, the discrimination content of the step S3 in the control flow chart of FIG. 16 was changed to discrimination as the whether or not the remaining developer amount is 0%, and other control steps are the same as those in the control flow chart of FIG. 1. Thus, in the image forming apparatus main assembly A1 in which the cartridge E is mounted, recycling detection of the constituent element is directly made and the recycling go/no-go discrimination information is stored in the non-volatile memory, so that accurate recycling discrimination of the constituent element is effected.

As described above, it becomes possible to effect the recycling go/no-go discrimination of the charging roller 2 by detecting the current, by the CPU 21, passing between the charging roller 2 and the drum 1 when the plurality of desired voltages as the charging bias from the non-discharging voltages to the discharging voltages.

As the discharging current detecting means of the charging roller 2, the method using the AC voltage is described, but the means may also be used of the DC voltage or the like and thus is not limited to that in this embodiment so long as the means has a similar constitution capable of detecting the discharging current value of the charging roller 2.

As the means for detecting the remaining developer amount value in the cartridge E, the electrostatic capacity method is described but may also be use of a transmission method or the like so long as a constitution capable of similarly detecting the remaining developer amount, and thus the means is not limited to that in this embodiment.

The lifetime of the recyclable cartridge is discriminated as the two types (long and short) from the current value change level Δ, but the lifetime discrimination is not limited to that in this embodiment but may also be effected as one type or three or more types, or the like types.

Embodiment 7

In Embodiments 1 to 4, whether or not the charging roller 2 was recyclable was discriminated from the current passing between the charging roller 2 and the drum 1. In Embodiments 5 and 6, the discharging component between the charging roller 2 and the drum 1 was detected by applying the plurality of the charging biases. On the other hand, in this embodiment, a constitution in which the discharging current (discharging amount) as the discharging component is detected from distortion of a charging bias waveform is employed. In this embodiment, repeated portions of those in Embodiment 1 will be omitted from description.

FIG. 19 shows a schematic illustration of a detecting method of the discharging component between the charging roller 2 and the drum 1 in this embodiment. In the apparatus main assembly A1, the charging bias power source S2 is provided, and to the charging roller 2, a voltage in the form of an AC voltage biased with a DC voltage is applied. When the charging bias is applied, an AC current passes through the charging roller 2 and the drum 1 in the cartridge E, thus flowing into the ground (GND).

The AC voltage at this time is detected by a voltage peak detector 50, and then a differentiated AC voltage is detected by a differentiated voltage peak detector 51. These detected values are inputted into the engine controller C. Then, from the detected voltage peak value and the detected differentiated voltage peak value, the discharging current passing through the charging roller 2 is detected (as will be described below with reference to FIG. 20). Therefore, the discharging current between the charging roller 2 and the photosensitive drum 1 under setting of AC voltage Vp-p.

Parts (a) and (b) of FIG. 20 are schematic waveform diagrams showing the discharging component detecting method in this embodiment, in which (a) shows the waveform in the non-discharging region, and (b) shows the waveform in the discharging region. In the non-discharging region, a detected voltage Vp by the voltage peak detector 50 and a detected voltage Vd by the differentiated voltage peak detector 50 are the same. On the other hand, in the discharging region, the detected voltage Vp by the voltage peak detector 50 and the detected voltage Vd by the differentiated voltage peak detector 51 are different from each other. This difference is generated by waveform distortion caused by the electric discharge.

The difference between Vp and Vd is detected by the engine controller C by using the above phenomenon, so that the discharging current is detected. That is, the discharging amount is detected from the distortion of the waveform of the current passing through the drum 1.

FIG. 21 shows a control flow chart of the image forming apparatus in this embodiment. In this embodiment, in comparison with the control flow chart of FIG. 16 in Embodiment 5, the control content of the step S12' in the control flow chart of FIG. 16 was changed to discrimination of the AC voltage peak and the differentiated AC voltage peak. Other control steps are the same as those in the control flow chart of FIG. 1.

Thus, in the image forming apparatus main assembly A1 in which the cartridge E is mounted, the recycling detection of the constituent element is directly made and then the recycling go/no-go discrimination information is stored in the non-volatile memory of the cartridge E, so that accurate recycling discrimination of the constituent element is effected.

As described above, the current passing through the charging roller 2 and the drum 1 is detected by the CPU 21 by detecting the AC voltage peak value and differentiated voltage peak value of the charging bias, and then the discharging current is calculated, so that it becomes possible to effect the recycling go/no-go discrimination of the charging roller 2.

With respect to timing of the recycling go/no-go discrimination of the charging roller 2, the method effected by detecting the photosensitive drum lifetime is described, but the timing is not limited to that in this embodiment but may also be timing of the remaining developer amount, timing of the number of passing sheets, and the like timing so long as at the timing, the lifetime of the cartridge E is similarly detectable.

The lifetime of the recyclable cartridge is discriminated as the two types from the discharging current value change level Δ, but the lifetime discrimination is not limited to that in this embodiment but may also be effected as one type or three or more types, or the like types.

Other Embodiments

1) In the above embodiments, the drum 1 and the transfer roller 5 are not spaced during the execution of the operation in the recycling go/no-go discrimination mode of the charging roller 2 as the image forming process member included in the cartridge E, but may also be spaced. In the case where the drum 1 and the transfer roller 5 are spaced, during the developer image formation, it is possible to prevent the transfer roller 5 from being contaminated with the developer.

2) In the above embodiments, the operation in the recycling go/no-go discrimination mode is executed with respect to the charging roller 2 as the image forming process member included in the cartridge E, but the image forming process member subjected to the recycling go/no-go discrimination is not limited to the charging roller (charging member) 2. Also with respect to the developing roller (developer carrying member) 41, similarly as in the case of the charging roller 2 in each of the embodiments, the recycling go/no-go discrimination can be effected.

Further, also with respect to the supplying roller (developer supplying member) 42 for supplying the developer to the developing roller 41 and the regulating roller (developer layer thickness regulating member) 43 for regulating the amount of the developer placed on the developing roller 41, it is possible to effect the recycling go/no-go discrimination similarly as in the case of the charging roller 2 in each of the embodiments.

3) In the present invention, the cartridge includes the process cartridge of the so-called integral type, the process cartridge of the discrete type, and the developing cartridge.

4) The image forming apparatus is not limited to those, in the above embodiments, of the electrophotographic image forming type using the electrophotographic photosensitive member as the image bearing member. For example, the image forming apparatus may also be those of an electrostatic recording image forming type using an electrostatic recording dielectric member as the image bearing member and of a magnetic recording image forming type using a magnetic recording magnetic member as the image bearing member.

5) In Embodiments 1 to 3, at the controller of the image forming apparatus, the state of the image forming process member is discriminated and its discrimination result is stored in the memory but the present invention is not limited thereto. For example, in Embodiment 1, the detected current value may also be stored, as information for discriminating the state of the image forming process member, in the memory. In that case, before the disassembling of the cartridge in the factory, the information stored in the memory is read and displayed on a display device or the like, and then a user may discriminate, from the detected current value, whether or not the image forming process member is recyclable. Even in this case, there is the information directly relating to the state of the image forming process member and therefore the recycling go/no-go discrimination of the image forming process member can be effected without disassembling the cartridge, so that cumbersome disassembling can be eliminated.

6) For that reason, the information stored in the memory may be not only the result of the recycling go/no-go discrimination but also may only be required to be information capable of discriminating the state of the image forming process member. For that reason, as the information for discriminating the state of the image forming process member, it would be considered that it is possible to use the detected current value, the plurality of current value change levels, the detected discharging component, the plurality of discharging component change levels, the distortion of the waveform of the current passing through the image bearing member, and the information on whether or not the image forming process member is recyclable. These may be stored as individual information in the memory but may also be stored in combination of plural pieces of the information.

7) In Embodiments 1 to 3, the description is made by using the non-volatile memory, but the memory may only be required to store the information and therefore is not limited to the non-volatile memory.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 047846/2012 filed Mar. 5, 2012 and 033018/2013 filed Feb. 22, 2013, which are hereby incorporated by reference.

What is claimed is:

1. An image forming apparatus for forming an image on a recording material, comprising:

a cartridge, detachably mountable to a main assembly of the image forming apparatus, including a memory and an image forming process member actable on an image bearing member in an image forming process; and current detecting means, provided in the main assembly, for detecting a value of current passing through the image forming process member, wherein the current detecting means detects the value of the current passing through the image forming process member when a voltage is applied to the image forming process member, and the memory stores information for discriminating whether or not the image forming process member is recyclable on the basis of the detected value of the current.

2. An image forming apparatus according to claim 1, wherein the information for discriminating whether or not the image forming process member is recyclable includes at least one of the detected value of the current, a change level of a plurality of current values, and recycling go/no-go information of the image forming process member.

3. An image forming apparatus according to claim 1, further comprising a controller for storing in the memory the information for discriminating whether or not the image forming process member is recyclable on the basis of the value of the current.

4. An image forming apparatus according to claim 3, wherein the controller discriminates an end of a lifetime of the cartridge on the basis of a rotation time of the image bearing member, and thereafter the current detecting means detects the value of the current passing through the image forming process member.

5. An image forming apparatus according to claim 1, wherein the image forming process member is any one of a charging member for electrically charging the image bearing member, a developer carrying member for developing with a developer a latent image formed on the image bearing member, a developer feeding member for feeding the developer to the developer carrying member, and a developer layer thickness regulating member for regulating an amount of the developer to be placed on the developer carrying member.

6. An image forming apparatus according to claim 1, wherein detection of the value of the current passing through the image forming process member is made periodically in an operation period from a brand-new state to an end of a lifetime of the cartridge.

7. An image forming apparatus according to claim 1, wherein detection of the value of the current passing through the image forming process member is made at timing depending on progression of a rotation time of the image bearing member.

8. An image forming apparatus according to claim 1, wherein detection of the value of the current passing through the image forming process member is made at timing depending on progression of a remaining developer amount of a developer accommodating portion.

9. An image forming apparatus for forming an image on a recording material, comprising:

a cartridge, detachably mountable to a main assembly of the image forming apparatus, including a memory and an image forming process member actable on an image bearing member in an image forming process; and discharging component detecting means, provided in the main assembly, for detecting a discharging component between the image bearing member and the image forming process member, wherein the discharging component detecting means detects the discharging component between the image bearing member and the image forming process member when a voltage is applied to the image forming process member, and the memory stores information for discriminating whether or not the image forming process member is recyclable on the basis of the detected discharging component.

10. An image forming apparatus according to claim 9, wherein the information for discriminating whether or not the image forming process member is recyclable includes at least one of the detected discharging component, a change level of a plurality of discharging components distortion of a waveform of a current passing through the image bearing member, and recycling go/no-go information of the image forming process member.

11. An image forming apparatus according to claim 9, further comprising a controller for storing in the memory the information for discriminating whether or not the image forming process member is recyclable on the basis of the discharging component.

12. An image forming apparatus according to claim 11, wherein the controller discriminates an end of a lifetime of the cartridge on the basis of a rotation time of the image bearing member, and thereafter the discharging component detecting means detects the discharging component between the image bearing member and the image forming process member.

13. An image forming apparatus according to claim 9, wherein the image forming process member is any one of a charging member for electrically charging the image bearing member, a developer carrying member for developing with a developer a latent image formed on the image bearing member, a developer feeding member for feeding the developer to the developer carrying member, and a developer layer thickness regulating member for regulating an amount of the developer to be placed on the developer carrying member.

14. An image forming apparatus according to claim 9, wherein the discharging component detecting means detects a discharge amount from a value of a current passing through the image bearing member when a plurality of voltages are applied to the image forming process member.

15. An image forming apparatus according to claim 9, wherein detection of the discharging component between the image bearing member and the image forming process member is made periodically in an operation period from a brand-new state to an end of a lifetime of the cartridge.

16. An image forming apparatus according to claim 9, wherein detection of the discharging component between the image bearing member and the image forming process member is made at timing depending on progression of a rotation time of the image bearing member.

17. An image forming apparatus according to claim 9, wherein detection of the discharging component between the image bearing member and the image forming process member is made at timing depending on progression of a remaining developer amount of a developer accommodating portion.

18. A cartridge recycling detecting system in an image forming apparatus for forming an image on a recording material, the cartridge recycling detecting system comprising:

a cartridge, detachably mountable to a main assembly of the image forming apparatus, including a memory and an image forming process member actable on an image bearing member in an image forming process; and current detecting means, provided in the main assembly, for detecting a value of current passing through the image forming process member, wherein the current detecting means detects the value of the current passing through the image forming process member when a voltage is applied to the image forming process member, and the memory stores information for discriminating whether or not the image forming process member is recyclable on the basis of the detected value of the current.

19. A cartridge recycling detecting system in an image forming apparatus for forming an image on a recording material, the cartridge recycling detecting system comprising:

a cartridge, detachably mountable to a main assembly of the image forming apparatus, including a memory and an image forming process member actable on an image bearing member in an image forming process; and discharging component detecting means, provided in the main assembly, for detecting a discharging component between the image bearing member and the image forming process member, wherein the discharging component detecting means detects the discharging component between the image bearing member and the image forming process member when a voltage is applied to the image forming process member, and the memory stores information for discriminating whether or not the image forming process member is recyclable on the basis of the detected discharging component.

20. A cartridge comprising:

a memory; and an image forming process member actable on an image bearing member in an image forming process, wherein the memory stores information for discriminating whether or not the image forming process member is recyclable on the basis of a detected value of a current passing through the image forming process member.

21. The cartridge according to claim 20, wherein the image forming process member is any one of a charging member for electrically charging the image bearing member, a developer carrying member for developing a latent image formed on the image bearing member, a developer feeding member for feeding the developer to the developer carrying member, and a developer layer thickness regulating member for regulating an amount of the developer to be placed on the developer carrying member.

22. The cartridge according to claim 20, wherein the cartridge includes the image bearing member.

23. An image forming apparatus for forming an image on a recording material, comprising:

a cartridge, detachably mountable to a main assembly of the image forming apparatus, including a memory and an image forming process member actable on an image bearing member in an image forming process;

current detecting means, provided in the main assembly, for detecting a value of current passing through the image forming process member; and a controller configured to compare information measured by the current detecting means with information stored in the memory and to write discriminating information into the memory in accordance with the comparison, wherein the memory stores the discriminating information for discriminating whether or not the image forming process member is recyclable on the basis of the detected value of the current.

* * * * *